US006487834B2

(12) United States Patent
Kagami

(10) Patent No.: US 6,487,834 B2
(45) Date of Patent: Dec. 3, 2002

(54) COIN WRAPPING MACHINE

(75) Inventor: Mitsuharu Kagami, Saitama (JP)

(73) Assignee: Laurel Precision Machine Co., Ltd., Osaka (JP)

( * ) Notice: Subject to any disclaimer, the term of this patent is extended or adjusted under 35 U.S.C. 154(b) by 0 days.

(21) Appl. No.: 09/930,909

(22) Filed: Aug. 16, 2001

(65) Prior Publication Data

US 2002/0023415 A1 Feb. 28, 2002

(30) Foreign Application Priority Data

Aug. 28, 2000 (JP) ..... 2000-257608

(51) Int. Cl.[7] ..... B65B 67/08
(52) U.S. Cl. ..... 53/498; 53/212; 53/500
(58) Field of Search ..... 53/212, 498, 500; 209/539, 551, 567, 568, 569, 576, 577, 587; 194/206, 207

(56) References Cited

U.S. PATENT DOCUMENTS 4,123,892 A * 11/1978 Asami ..... 453/31
4,195,463 A * 4/1980 Bergman et al. ..... 53/212
4,409,773 A * 10/1983 Bergman et al. ..... 52/54
4,442,541 A * 4/1984 Finkel et al. ..... 209/534
4,861,312 A * 8/1989 Sentoku ..... 453/31
4,896,481 A * 1/1990 Sentoku et al. ..... 53/212
4,897,984 A * 2/1990 Sentoku et al. ..... 53/212
4,949,532 A * 8/1990 Fujimagari et al. ..... 198/417
5,002,516 A * 3/1991 Watanabe et al. ..... 453/31
5,105,601 A * 4/1992 Horiguchi et al. ..... 53/212
5,514,034 A * 5/1996 Jones et al. ..... 453/10
5,718,625 A * 2/1998 Bointon ..... 414/796.8
5,743,372 A * 4/1998 Furuya ..... 194/318

FOREIGN PATENT DOCUMENTS

JP 10-105764 4/1998

* cited by examiner

*Primary Examiner*—Scott A. Smith
*Assistant Examiner*—Nathaniel Chukwurah
(74) *Attorney, Agent, or Firm*—Cohen, Pontani, Lieberman & Pavane

(57) ABSTRACT

A coin wrapping machine includes an operation mode selector for selecting a counting mode for counting coins or a wrapping mode for wrapping coins, a coin passage, a first coin sensor provided in the coin passage for detecting physical properties of coins, a second coin sensor provided in the coin passage downstream of the first coin sensor for detecting physical properties of coins different from those to be detected by the first coin sensor, a first coin sorter provided in the coin passage downstream of the second coin sensor for sorting, a second coin sorter provided in the coin passage downstream of the second coin sensor for sorting coins, a third coin sorter provided in the coin passage downstream of the second coin sensor for sorting coins, and a discriminator for discriminating, based on the physical properties detected by the first coin sensor and the second coin sensor, and the second coin sorter being made responsive to such inclusion for sorting one kind between the new issue coins and the past issue circulating coins.

30 Claims, 10 Drawing Sheets

COIN WRAPPING MACHINE

BACKGROUND OF THE INVENTION

The present invention relates to a coin wrapping machine and, particularly, to such a machine which can reliably sort new issue coins and past issue circulating old coins of the same denomination from each other and efficiently collect old coins without any special mechanism and, more particularly, to such a machine which can reliably sort new issue coins and past issue circulating old coins of the same denomination from each other, efficiently collect old coins without any special mechanism while counting the new issue coins and the old coins and, at the same time, wrap the new issue coins to produce a wrapped coin roll.

DESCRIPTION OF THE PRIOR ART

As disclosed in, for example, Japanese Patent Application Laid Open No. 10-105764, a coin wrapping machine is generally constituted to feed coins one by one by a rotatable disk into a coin passage, discriminate whether or not each coin is acceptable and the denomination of the coin based on magnetic data and/or optical data of the coin detected by a sensor and wrap or count coins of the denomination specified by an operator, while it separately collects unacceptable coins and coins other than those to be wrapped or counted.

Recently, cases have arisen in which coins of the same denomination as circulated coins but different magnetic properties and surface patterns from those of the circulated coins have been newly issued in order to avoid coin counterfeiting and the like and in such cases, it is usual for old coins circulated before the issuance of new coins to be gradually collected and replaced by new issue coins.

In Japan, 500 yen coins have been newly issued in order to avoid coin counterfeiting and it is expected that 500 yen coins circulated be fore the issuance of the new 500 yen coins will be gradually collected and replaced by the newly issued 500 yen coins.

When coins of the same denomination as that of coins circulated are newly issued, in order to ensure that old coins circulated before the issuance of the new coins are gradually collected and replaced by the new issue coins, a coin wrapping machine has to be constituted to sort the coins circulated before the issuance of the new coins from the new issue coins.

However, a conventional coin wrapping machine has only a function of sorting coins to be wrapped or counted from unacceptable coins such as counterfeit coins, foreign coins and the like and coins of other denominations, wrapping or counting them, but has no function of sorting coins circulated before the issuance of new coins from new issue coins and cannot sort and collect only the old coins of the same denomination as that of the new coins from the new issue coins.

This problem can be solved by providing a conventional coin wrapping machine with a special mechanism for sorting circulated old coins from new issue coins. However, provision of a special mechanism for sorting circulated old coins from new issue coins in order to collect circulated old coins leads to higher cost and such a special mechanism becomes useless after the collection of the circulated old coins has been completed. Therefore, this solution is very uneconomical.

SUMMARY OF THE INVENTION

It is therefore an object of the present invention to provide a coin wrapping machine which can reliably sort new issue coins and past issue circulating old coins of the same denomination from each other and efficiently collect old coins without any special mechanism.

It is a further object of the present invention to provide a coin wrapping machine which can reliably sort new issue coins and past issue circulating old coins of the same denomination from each other, efficiently collect old coins without any special mechanism while counting the new issue coins and the old coins and, at the same time, wrap the new issue coins to produce a wrapped coin roll.

The above other objects of the present invention can be accomplished by a coin wrapping machine comprising an operation mode selecting means for selecting a counting mode for counting coins or a wrapping mode for wrapping coins, a denomination specifying means for specifying a denomination of coins to be handled, a rotatable disk for feeding coins one by one to a coin passage, a first coin sensor provided in the coin passage for detecting physical properties of coins, a second coin sensor provided in the coin passage downstream of the first coin sensor for detecting physical properties of coins different from those to be detected by the first coin sensor, a first coin sorting and collecting means provided in the coin passage downstream of the second coin sensor for sorting coins and collecting sorted coins, a second coin sorting and collecting means provided in the coin passage downstream of the second coin sensor for sorting coins and collecting sorted coins, a third coin sorting and collecting means provided in the coin passage downstream of the second coin sensor for sorting coins and collecting sorted coins, a discriminating means for discriminating, based on the physical properties detected by the first coin sensor and the second coin sensor, whether or not a coin is acceptable, the denomination of the coin when it is acceptable and whether or not the denomination of the coin coincides with that specified by the denomination specifying means, and a coin stacking and wrapping apparatus connected to a downstream end portion of the coin passage for stacking and wrapping coins, the discriminating means being made responsive to inclusion of new issue coins and past issue circulating coins among coins of the denomination for further discriminating whether the coin is a new issue coin or a past issue circulating coin, the first coin sorting and collecting means being made responsive to such inclusion for sorting and collecting coins discriminated unacceptable by the discriminating means when the counting mode is selected by the operation mode selecting means, and the second coin sorting and collecting means being made responsive to such inclusion for sorting and collecting one kind between the new issue coins and the past issue circulating coins.

According to the present invention, when the counting mode is selected, since the first coin sorting and collecting means sorts and collects coins discriminated unacceptable by the discriminating means and the second coin sorting and collecting means is made responsive to inclusion of new issue coins and past issue circulating coins among coins of the denomination for sorting and collecting one kind between the new issue coins and the past issue circulating coins, if the first coin sorting and collecting means or the second coin sorting and collecting means is constituted to sort and collect coins of denominations different from that specified by the denomination specifying means, and the third coin sorting and collecting means is made responsive to such inclusion for sorting and collecting the other kind between the new issue coins and the past issue circulating coins, it is possible to sort and collect one kind between the new issue coins and the past issue circulating coins by the second coin sorting and collecting means and collect the other kind between the new issue coins and the past issue circulating coins by the third coin sorting and collecting means. Therefore, it is possible to reliably sort the new issue coins and past issue circulating old coins of the same denomination from each other without providing any special mechanism and efficiently collect the past issue circulating old coins.

In a preferred aspect of the present invention, the third coin sorting and collecting means is made responsive to inclusion of new issue coins and past issue circulating coins among coins of the denomination specified by the denomination specifying means for sorting and collecting the other kind between the new issue coins and the past issue circulating coins.

According to this preferred aspect of the present invention, the first coin sorting and collecting means is constituted to sort and collect coins discriminated unacceptable by the discriminating means and the second coin sorting and collecting means is made responsive to inclusion of new issue coins and past issue circulating coins among coins of the denomination for sorting and collecting one kind between the new issue coins and the past issue circulating coins, while the third coin sorting and collecting means is made responsive to such inclusion for sorting and collecting the other kind between the new issue coins and the past issue circulating coins. Therefore, by constituting the first coin sorting and collecting means or the second coin sorting and collecting means to sort and collect coins of denominations different from that specified by the denomination specifying means, it is possible to collect one kind between the new issue coins and the past issue circulating coins by the second coin sorting and collecting means and collect the other kind between the new issue coins and the past issue circulating coins by the third coin sorting and collecting means. Accordingly, it is possible to reliably sort the new issue coins and past issue circulating old coins of the same denomination from each other without providing any special mechanism and efficiently collect the past issue circulating old coins.

In a further preferred aspect of the present invention, the second coin sorting and collecting means is made responsive to inclusion of new issue coins and past issue circulating coins among coins of the denomination specified by the denomination specifying means for sorting and collecting coins of denominations different from that specified by the denomination specifying means in addition to one kind between the new issue coins and the past issue circulating coins.

According to this preferred aspect of the present invention, since the second coin sorting and collecting means is constituted to sort and collect one kind between the new issue coins and the past issue circulating coins and coins of denominations different from that specified by the denomination specifying means, it is possible to collect one kind between the new issue coins and the past issue circulating coins and coins of denominations different from that specified by the denomination specifying means by the second coin sorting and collecting means and collect the other kind between the new issue coins and the past issue circulating coins by the third coin sorting and collecting means. Therefore, it is possible to reliably sort the new issue coins and past issue circulating old coins of the same denomination from each other without providing any special mechanism and efficiently collect the past issue circulating old coins.

In another preferred aspect of the present invention, the third coin sorting and collecting means is made responsive to inclusion of new issue coins and past issue circulating coins among coins of the denomination specified by the denomination specifying means for sorting and collecting coins of denominations different from that specified by the denomination specifying means in addition to the other kind between the new issue coins and the past issue circulating coins.

According to this preferred aspect of the present invention, since the second coin sorting and collecting means is constituted to sort and collect one kind between the new issue coins and the past issue circulating coins, and the third coin sorting and collecting means is constituted to sort and collect coins of denominations different from that specified by the denomination specifying means in addition to the other kind between the new issue coins and the past issue circulating coins, it is possible to collect one kind between the new issue coins and the past issue circulating coins by the second coin sorting and collecting means and collect the other kind between the new issue coins and the past issue circulating coins and coins of denominations different from that specified by the denomination specifying means by the third coin sorting and collecting means. Therefore, it is possible to reliably sort the new issue coins and past issue circulating old coins of the same denomination from each other without providing any special mechanism and efficiently collect the past issue circulating old coins.

In another preferred aspect of the present invention, the first coin sorting and collecting means is made responsive to inclusion of new issue coins and past issue circulating coins among coins of the denomination specified by the denomination specifying means for sorting and collecting coins of denominations different from that specified by the denomination specifying means in addition to coins discriminated unacceptable by the discriminating means.

According to this preferred aspect of the present invention, since the first coin sorting and collecting means is constituted to sort and collect coins of denominations different from that specified by the denomination specifying means in addition to coins discriminated unacceptable by the discriminating means, the second coin sorting and collecting means is constituted to sort and collect one kind between the new issue coins and the past issue circulating coins, and the third coin sorting and collecting means is constituted to sort and collect the other kind between the new issue coins and the past issue circulating coins, it is possible to reliably sort the new issue coins and past issue circulating old coins of the same denomination from each other without providing any special mechanism and efficiently collect the past issue circulating old coins.

In another preferred aspect of the present invention, the first coin sorting and collecting means is made responsive to inclusion of new issue coins and past issue circulating coins among coins of the denomination specified by the denomination specifying means for sorting and collecting the other kind between the new issue coins and the past issue circulating coins in addition to coins discriminated unacceptable by the discriminating means, and the third coin sorting and collecting means is constituted to sort and collect coins of denominations different from that specified by the denomination specifying means.

According to this preferred aspect of the present invention, the first coin sorting and collecting means is constituted to sort and collect the other kind between the new issue coins- and the past issue circulating coins in addition to coins discriminated by the discriminating means and the second coin sorting and collecting means is constituted to sort and collect one kind between the new issue coins and the past issue circulating coins, while the third coin sorting and collecting means is constituted to sort and collect coins of denominations different from that specified by the denomination specifying means. Therefore, it is possible to reliably sort the new issue coins and past issue circulating old coins of the same denomination from each other without providing any special mechanism and efficiently collect the past issue circulating old coins.

In a further preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

According to this preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins. Therefore, by sorting and collecting unacceptable coins by the first coin sorting and collecting means, sorting and collecting coins of denominations different from that specified by the denomination specifying means by the second coin sorting and collecting means and sorting and collecting the past issue circulating coins by the third coin sorting and collecting means, it is possible to feed only the new issue coins to the coin stacking and wrapping apparatus to wrap them. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to the wrapping operation of coins, sorting and collecting coins including the past issue circulating coins by the second coin sorting and collecting means and feeding collected coins onto the rotatable disk to perform the operation for wrapping the new issue coins, it is possible to efficiently sort and collect unacceptable coins by the first coin sorting and collecting means, efficiently sort and collect coins of denominations different from that specified by the denomination specifying means by the second coin sorting and collecting means, and sort and collect the past issue circulating coins by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In another preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

According to this preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means. Therefore, by sorting and collecting unacceptable coins by the first coin sorting and collecting means, sorting and collecting the past issue circulating coins by the second coin sorting and collecting means and sorting and collecting coins of denominations different from that specified by the denomination specifying means by the third coin sorting and collecting means, it is possible to feed only the new issue coins to the coin stacking and wrapping apparatus to wrap them. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to wrapping coins, sorting and collecting coins including the past issue circulating coins by the second coin sorting and collecting means and feeding collected coins onto the rotatable disk to perform the operation for wrapping the new issue coins, it is possible to efficiently sort and collect unacceptable coins by the first coin sorting and collecting means, efficiently sort and collect the past issue circulating old coins by the second coin sorting and collecting means, and sort and collect the coins of denominations different from that specified by the denomination specifying means by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In a further preferred aspect of the present invention, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting coins of denominations different from that specified by the denomination specifying means, the second coin sorting and collecting means is made responsive to such inclusion and specification for sorting and collecting unacceptable coins, and the third coin sorting and collecting means is made responsive to such inclusion and specification for sorting and collecting past issue circulating coins.

According to this preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting coins of denominations different from that specified by the denomination specifying means, the second coin sorting and collecting means is made response to such inclusion and specification for sorting and collecting unacceptable coins and the third, coin sorting and collecting means is made responsive to such inclusion and specification for sorting and collecting the past issue circulating coins. Therefore, by sorting and collecting the coins of denominations different from that specified by the denomination specifying means by the first coin sorting and collecting means, sorting and collecting unacceptable coins by the second coin sorting and collecting means and sorting and collecting the past issue circulating coins by the third coin sorting and collecting means, it is possible to feed only the new issue coins to the coin stacking and wrapping apparatus to wrap them. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to wrapping coins, sorting and collecting coins including the past issue circulating coins by the second coin sorting and collecting means and feeding collected coins onto the rotatable disk to perform the operation for wrapping the new issue coins, it is possible to efficiently sort and collect the coins of denominations different from that specified by the denomination specifying means by the first coin sorting and collecting means, efficiently sort and collect unacceptable coins by the second coin sorting and collecting means, and sort and collect the past issue circulating coins by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In a further preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting coins of denominations different from that specified by the denomination specifying means, the second coin sorting and collecting means is made responsive to such inclusion and specification for sorting and collecting past issue circulating coins, and the third coin sorting and collecting means is made responsive to such inclusion and specification for sorting and collecting unacceptable coins.

According to this preferred aspect of the present invention, in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting coins of denominations different from that specified by the denomination specifying means, the second coin sorting and collecting means is made responsive to such inclusion and specification for sorting and collecting past issue circulating coins, and the third coin sorting and collecting means is made responsive to such inclusion and specification for sorting and collecting unacceptable coins. Therefore, by the first coin sorting and collecting means, sorting and collecting the past issue circulating coins by the second coin sorting and collecting means and sorting and collecting unacceptable coins by the third coin sorting and collecting means, it is possible to feed only the new issue coins to the coin stacking and wrapping apparatus to wrap them by sorting and collecting the coins of denominations different from that specified by the denomination specifying means. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to wrapping coins, sorting and collecting coins including the past issue circulating coins by the second coin sorting and collecting means and feeding collected coins onto the rotatable disk to perform the operation for wrapping the new issue coins, it is possible to efficiently sort and collect the coins of denominations different from that specified by the denomination specifying means by the first coin sorting and collecting means, efficiently sort and collect the past issue circulating coins by the second coin sorting and collecting means, and sort and collect unacceptable coins by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In another preferred aspect of the present invention, in the case where the wrapping mode is selected by the operation mode selecting means, the first coin sorting means is made responsive to inclusion of new issue coins and past issue circulating coins among coins of the denomination specified by the denomination specifying means and specification of the denomination of the new issue coins as the denomination of coins to be wrapped for sorting and collecting past issue circulating coins, the second coin sorting and collecting means is made responsive to such inclusion and specification for sorting and collecting unacceptable coins, and the third coin sorting and collecting means is made responsive to such inclusion and specification for sorting and collecting coins of denominations different from that specified by the denomination specifying means.

According to this preferred aspect of the present invention, in the case where the wrapping mode is selected by the operation mode selecting means, the first coin sorting means is made responsive to inclusion of new issue coins and past issue circulating coins among coins of the denomination specified by the denomination specifying means and specification of the denomination of the new issue coins as the denomination of coins to be wrapped for sorting and collecting past issue circulating coins, the second coin sorting and collecting means is made responsive to such inclusion and specification for sorting and collecting unacceptable coins, and the third coin sorting and collecting means is made responsive to such inclusion and specification for sorting and collecting coins of denominations different from that specified by the denomination specifying means. Therefore, by sorting and collecting the past issue circulating coins by the first coin sorting means, sorting and collecting unacceptable coins by the second coin sorting and collecting means, and sorting and collecting the coins of denominations different from that specified by the denomination specifying means, it is possible to feed only the new issue coins to the coin stacking and wrapping apparatus to wrap them. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to wrapping coins, sorting and collecting coins including the past issue circulating coins by the second coin sorting and collecting means and feeding collected coins onto the rotatable disk to perform the operation for wrapping the new issue coins, it is possible to efficiently sort and collect the past issue circulating coins by the first coin sorting means, efficiently sort and collect unacceptable coins by the second coin sorting and collecting means, and sort and collect the coins of denominations different from that specified by the denomination specifying means by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In another preferred aspect of the present invention, in the case where the wrapping mode is selected by the operation mode selecting means, the first coin sorting means is made responsive to inclusion of new issue coins and past issue circulating coins among coins of the denomination specified by the denomination specifying means and specification of the denomination of the new issue coins as the denomination of coins to be wrapped for sorting and collecting past issue circulating coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting unacceptable coins.

According to this preferred aspect of the present invention, in the case where the wrapping mode is selected by the operation mode selecting means, the first coin sorting means is made responsive to inclusion of new issue coins and past issue circulating coins among coins of the denomination specified by the denomination specifying means and specification of the denomination of the new issue coins as the denomination of coins to be wrapped for sorting and collecting past issue circulating coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting unacceptable coins. Therefore, by the first coin sorting means, sorting and collecting the coins of denominations different from that specified by the denomination specifying means by the second coin sorting and collecting means, and sorting and collecting unacceptable coins by the third coin sorting and collecting means, it is possible to feed only the new issue coins to the coin stacking and wrapping apparatus to wrap them by sorting and collecting the past issue circulating coins. Accordingly, it is possible to reliably sort the new issue coins and past issue circulating old coins of the same denomination from each other without providing any special mechanism, thereby efficiently collecting the past issue circulating old coins and wrapping only the new issue coins. In particular, by selecting the counting mode to perform the operation for sorting and collecting coins prior to wrapping coins, sorting and collecting coins including the past issue circulating coins by the second coin sorting and collecting means and feeding collected coins onto the rotatable disk to perform the operation for wrapping the new issue coins, it is possible to efficiently sort and collect the past issue circulating coins by the first coin sorting and collecting means, efficiently sort and collect the coins of denominations different from that specified by the denomination specifying means by the second coin sorting and collecting means, and sort and collect unacceptable coins by the third coin sorting and collecting means, thereby reliably and efficiently feeding only new issue coins to the coin stacking and wrapping apparatus. Therefore, it is possible to reliably sort the new issue coins and past issue circulating old coins of the same denomination from each other without providing any special mechanism, thereby efficiently collecting the past issue circulating old coins and wrapping only the new issue coins.

In a preferred aspect of the present invention, the first coin sorting and collecting means in provided with a first coin sorting member movable between a projection position where it projects into the coin passage and a retracted position where it is retracted from the coin passage and a first coin sorting and collecting opening having a width smaller than a diameter of the smallest coins to be handled, the second coin sorting and collecting means is provided with a second coin sorting member movable between a projection position where it projects into the coin passage and a retracted position where it is retracted from the coin passage and a second coin sorting and collecting opening having a width smaller than a diameter of the smallest coins to be handled, and the third coin sorting and collecting means is provided with a third coin sorting member movable between a projection position where it projects into the coin passage and a retracted position where it is retracted from the coin passage and a third coin sorting and collecting opening having a width smaller than a diameter of the smallest coins to be handled.

According to this preferred aspect of the present invention, it is possible to drop coins into the first coin sorting and collecting opening by locating the first coin sorting member at the projection position thereof, thereby sorting and collecting the coins, to drop coins into the second coin sorting and collecting opening by locating the second coin sorting member at the projection position thereof, thereby sorting and collecting the coins, and to drop coins into the third coin sorting and collecting opening by locating the third coin sorting member at the projection position thereof, thereby sorting and collecting the coins. Therefore, coins can be sorted and collected in a desired manner by the first coin sorting member, the second coin sorting member and the third coin sorting member.

In a further preferred aspect of the present invention, the first coin sorting and collecting means is constituted to locate the first coin sorting member at the projection position thereof and to drop coins into the first coin sorting and collecting opening to sort them, the second coin sorting and collecting means is constituted to locate the second coin sorting member at the projection position thereof and to drop coins into the second coin sorting and collecting opening to sort them, and the third coin sorting and collecting means is constituted to locate the third coin sorting member at the projection position thereof and to drop coins into the third coin sorting and collecting opening to sort them.

In a further preferred aspect of the present invention, each of the first coin sorting member, the second coin sorting member and the third coin sorting member can be driven by a solenoid.

In a further preferred aspect of the present invention, at least one of the first coin sorting and collecting means, the second coin sorting and collecting means and the third coin sorting and collecting means includes a coin accommodating section where sorted and collected coin are to be accommodated and the coin wrapping machine further includes a coin feeding means for feeding coins accommodated in the coin accommodating section onto the rotatable disk.

According to this preferred aspect of the present invention, since the at least one of the first coin sorting and collecting means, the second coin sorting and collecting means and the third coin sorting and collecting means includes a coin accommodating section where sorted and collected coin are to be accommodated and the coin wrapping machine further includes the coin feeding means for feeding coins accommodated in the coin accommodating section onto the rotatable disk, it is possible to reliably sort the new issue coins and past issue circulating old coins of the same denomination from each other without providing any special mechanism, thereby efficiently collecting the past issue circulating old coins and wrapping only the new issue coins by selecting the counting mode to perform the operation for sorting and collecting coins prior to wrapping coins, sorting coins including the past issue circulating coins by the at least one of the first coin sorting and collecting means, the second coin sorting and collecting means and the third coin sorting and collecting means to collect them in the coin accommodating section, feeding coins accommodated in the coin accommodating section onto the rotatable disk by the coin feeding means and wrapping the new issue coins.

In a further preferred aspect of the present invention, the coin feeding means is provided with an endless belt formed with a plurality of engaging portions for engaging coins and disposed between the coin accommodating section and the rotatable disk.

In a further preferred aspect of the present invention, the coin feeding means further includes a disengaging means for disengaging the engagement between the coins and the plurality of engaging portions.

According to this preferred aspect of the present invention, since coins including the past issue circulating old coins can be sorted by the at least one of the first coin sorting and collecting means, the second coin sorting and collecting means and the third coin sorting and collecting means by selecting the counting mode to perform the operation for sorting and collecting coins prior to wrapping coins and collected in the coin accommodating section and the coins collected in the coin accommodating section can be reliably fed onto the rotatable disk, it is possible to reliably sort the new issue coins and past issue circulating old coins of the same denomination from each other without providing any special mechanism by feeding coins including the past issue circulating old coins collected in the coin accommodating section onto the rotatable disk and wrapping new issue coins, thereby efficiently collecting the past issue circulating old coins and wrapping only the new issue coins.

In a further preferred aspect of the present invention, the first coin sorting and collecting means is provided in the coin passage upstream of the second coin sorting and collecting means and the third coin sorting and collecting means is provided in the coin passage downstream of the second coin sorting and collecting means.

In a further preferred aspect of the present invention, the first coin sorting and collecting means is provided in the coin passage upstream of the third coin sorting and collecting means and the third coin sorting and collecting means is provided in the coin passage upstream of the second coin sorting and collecting means.

In a further preferred aspect of the present invention, the second coin sorting and collecting means is provided in the coin passage upstream of the first coin sorting and collecting means and the third coin sorting and collecting means is provided in the coin passage downstream of the first coin sorting and collecting means.

In a further preferred aspect of the present invention, the second coin sorting and collecting means is provided in the coin passage upstream of the third coin sorting and collecting means and the third coin sorting and collecting means is provided in the coin passage upstream of the first coin sorting and collecting means.

In a further preferred aspect of the present invention, the third coin sorting and collecting means is provided in the coin passage upstream of the first coin sorting and collecting means and the second coin sorting and collecting means is provided in the coin passage downstream of the first coin sorting and collecting means.

In a further preferred aspect of the present invention, the third coin sorting and collecting means is provided in the coin passage upstream of the first coin sorting and collecting means and the second coin sorting and collecting means is provided in the coin passage upstream of the first coin sorting and collecting means.

The above and other objects and features of the present invention will become apparent from the following description made with reference to the accompanying drawings.

DESCRIPTION OF THE PREFERRED EMBODIMENT

Figure 1:
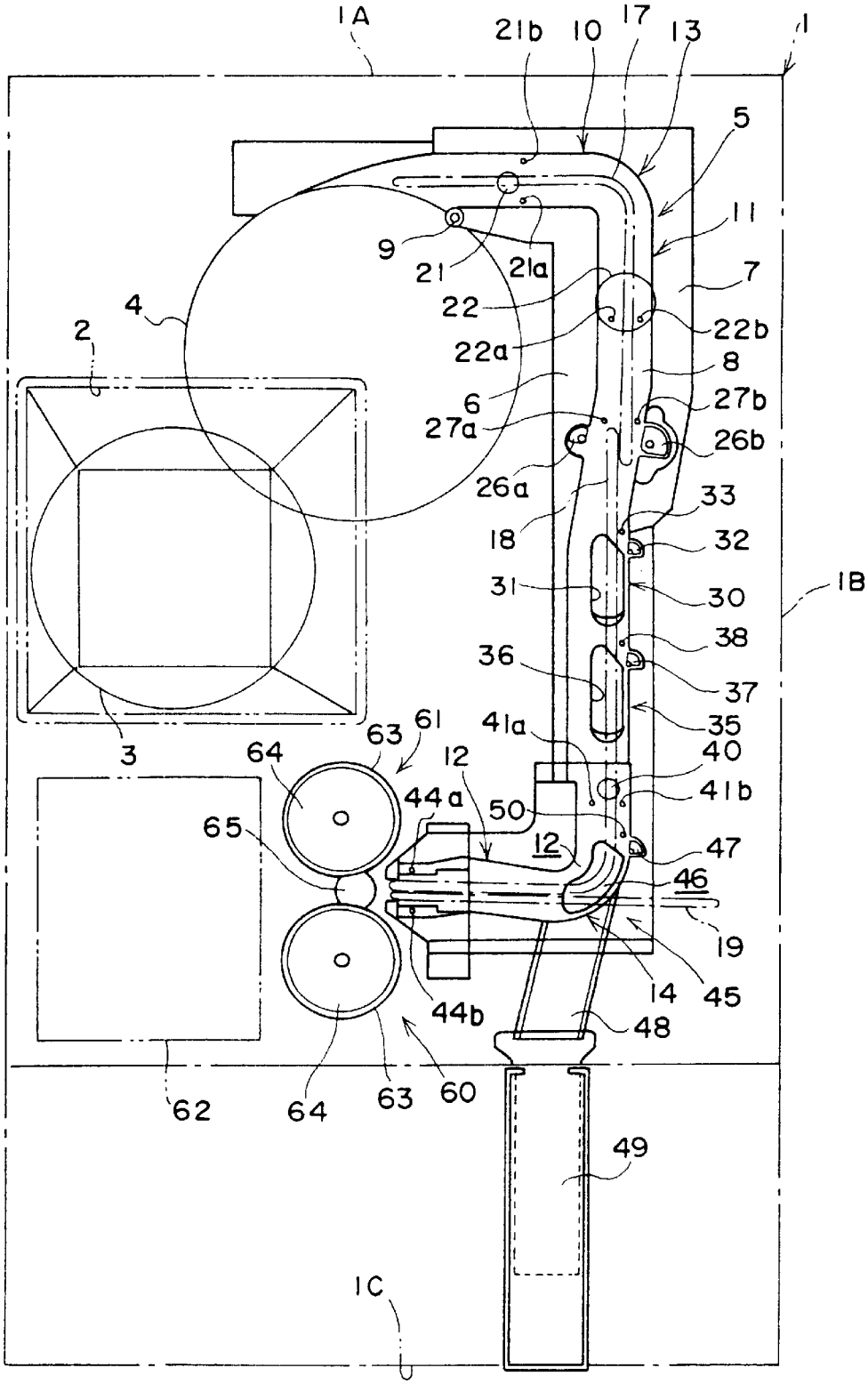
FIG. 1 is a schematic plan view showing a coin sorting mechanism of a coin wrapping machine which is a preferred embodiment of the present invention.

As shown in FIG. 1, an upper surface of a main body 1 of a coin wrapping machine is formed with a coin depositing opening 2 and a rotatable disk 3 rotatable about a vertical axis is provided below the coin depositing opening 2 for receiving coins deposited through the coin depositing opening 2 on the upper surface thereof and feeding them to the inside of the coin wrapping machine.

A rotatable disk 4 rotatable about a vertical axis is provided adjacent to the rotatable disk 3 and coins deposited into the coin depositing opening 2 and fed onto the rotatable disk 3 are fed one by one by centrifugal force produced by the rotation of the rotatable disk 3 onto the rotatable disk 4.

The rotatable disk 4 is constituted so as to feed coins fed from the rotatable disk 3 by centrifugal force produced by the rotation of the rotatable disk 4 into a coin passage 5 via a coin separating member (not shown). The coin separating member forms a gap greater than the thickness of the thickest coins to be handled and smaller than double the thickness of thinnest coins to be handled between itself and the upper surface of the rotatable disk 4 and serves to ensure that coins are fed one by one into the coin passage 5.

The coin passage 5 is defined by a pair of guide members 6, 7 so that coins are fed on a coin passage surface 8 and is formed in the horizontal plane along a rear surface portion 1A, a side surface portion 1B and a front surface portion 1C of the main body 1 of the coin wrapping machine so as to surround the rotatable disk 3 and the rotatable disk 4.

As shown in FIG. 1, a guide roller 9 is provided at a starting end portion of the guide member 6 for leading coins fed from the rotatable disk 4 and colliding thereagainst into the coin passage 5.

The coin passage 5 is connected to the rotatable disk 4 at the upstream end portion thereof and includes a first straight passage 10 extending substantially parallel to the rear surface portion 1A of the main body 1 of the coin wrapping machine, a second straight passage 11 extending substantially parallel to the side surface portion 1B of the main body 1 of the coin wrapping machine and substantially perpendicularly to the first straight passage 10, a third straight passage 12 extending substantially parallel to the front surface portion 1C of the main body 1 of the coin wrapping machine and substantially perpendicularly to the second straight passage 11, a first curved passage 13 connected to the downstream end portion of the first straight passage 10 and the upstream end portion of the second straight passage 11 for turning the coin transporting direction by substantially 90 degrees and a second curved passage 14 connected to the downstream end portion of the second straight passage 11 and the upstream end portion of the third straight passage 12 for turning the coin transporting direction by substantially 90 degrees, thereby being disposed to surround the rotatable disk 4.

Above the coin passage 5, a first transporting belt 17 and a second transporting belt 18 are provided. The first transporting belt 17 extends from a portion above the first straight passage 10 via a portion above the first curved passage 13 to a portion above a substantially central portion in the length direction of the second straight passage 11, and the second transporting belt 18 extends from a portion above the portion above a substantially central portion in the length direction of the second straight passage 11 via a portion above the second curved passage 14 to a portion above the third straight passage 12. As shown in FIG. 1, both the first transporting belt 17 and second transporting belt 18 are disposed above the portion above a substantially central portion in the length direction of the second straight passage 11, thereby enabling a coin transported by the first transporting belt 17 to be delivered to the second transporting belt 18. In FIG. 1, the reference numeral 19 designates a belt for transmitting a driving force of a motor (not shown) to the first transporting belt 17 and the second transporting belt 18. The first transporting belt 17, the second transporting belt 18 and the belt 19 can be driven in a forward direction and in a reverse direction.

A magnetic sensor 21 for detecting magnetic properties of coins is provided in the first straight passage 10 to be located in the coin passage surface 8.

On the opposite sides, a pair of coin sensors 21*a*, 21*b* are provided and when the pair of coin sensors 21*a*, 21*b* detect a coin, the magnetic sensor 21 outputs detected magnetic data of the coin as a detection signal.

An optical sensor 22 is provided for detecting diameters and surface patterns of coins in the second straight passage 11 connected to the downstream end portion of the first straight passage 10 so as to be located in the coin passage surface 8.

On the opposite sides of the optical sensor 22, a pair of coin sensors 22*a*, 22*b* are provided and the optical sensor 22 is constituted so as to output detected diameter data and surface pattern data as a detection signal when the pair of coin sensors 22*a*, 22*b* detect a coin.

Stopper members 26*a*, 26*b* facing each other are provided in recesses formed in the guide members 6, 7 located downstream of the optical sensor 22 in the second straight passage 11. Each of the stopper members 26*a*, 26*b* is rotatable about a vertical axis by a solenoid (not shown) between a projecting position located in the second straight passage 11 and a retracted position where it is retracted from the second straight passage 11.

A pair of coin sensors 27*a* , 27*b* are provided in the second straight passage 11 immediately upstream of the stopper members 26*a*, 26*b* and when the pair of coin sensors 27*a*, 27*b* detect a coin to be stopped, the stopper members 26*a*, 26*b* are driven.

A first coin sorting and collecting means 30 is provided in the second straight passage 11 downstream of the stopper members 26*a*, 26*b* for sorting coins including at least unacceptable coins such as counterfeit coins, foreign coins and the like and collecting them. The first coin sorting and collecting means 30 includes a first coin sorting and collecting opening 31 formed in the coin passage surface 8 and a first coin sorting member 32 provided in a recess formed in the guide member 7.

Figure 2:
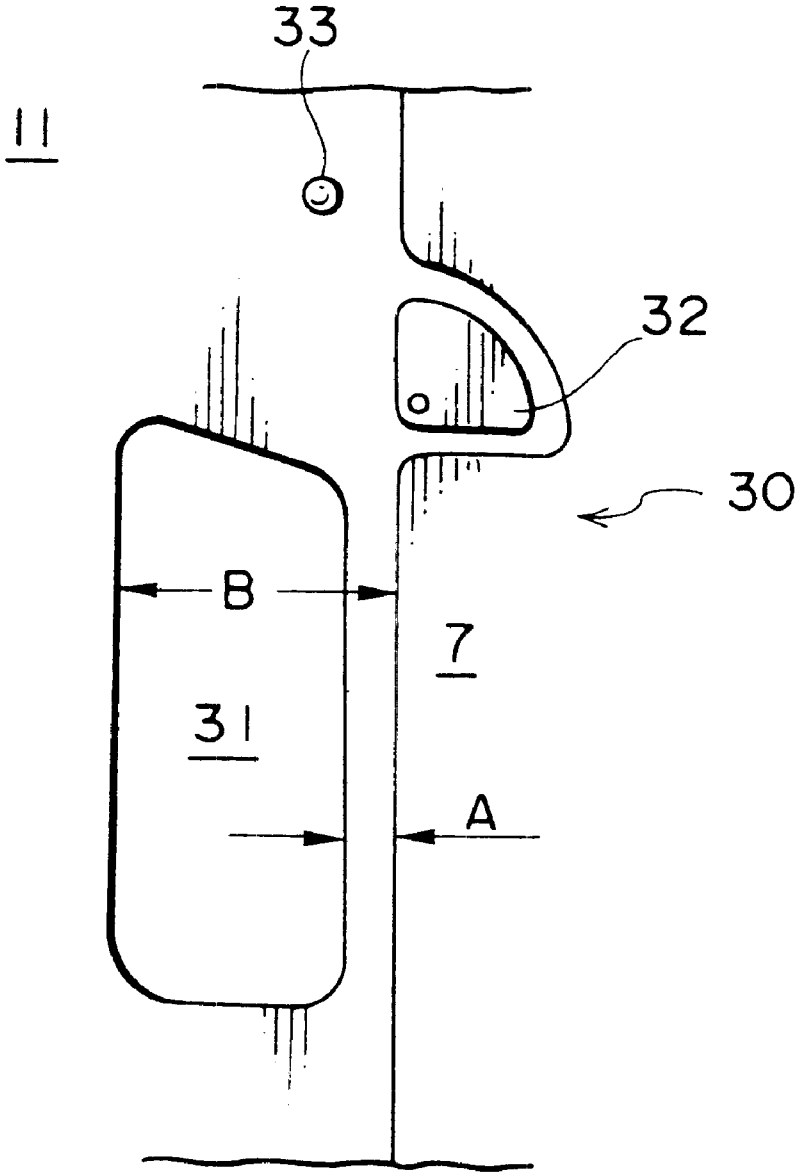
FIG. 2 is a schematic enlarged plan view of a first coin sorting and collecting means.

FIG. 2 is a schematic enlarged plan view showing the first coin sorting and collecting means 30.

As shown in FIG. 2, the first coin sorting member 32 is rotatable about a vertical axis by a solenoid (not shown) between a projecting position located in the second straight passage 11 and a retracted position where it is retracted from the second straight passage 11 and is flush with the surface of the guide member 7 on the side of the second straight passage 11.

In FIG. 2, the distance A between the surface of the guide member 7 on the side of the second straight passage 11 and the edge portion of the first coin sorting and collecting opening 31 on the side of the guide member 7 is shorter than a length of the first coin sorting member 32 located at the projecting position thereof and projecting from the surface of the guide member 7 but is enough to support one edge portion of a coin and guide the coin. The distance B between the surface of the guide member 7 on the side of the second straight passage 11 and the edge portion of the first coin sorting and collecting opening 31 on the side of the guide member 6 is determined slightly smaller than the diameter of the smallest diameter coins to be handled.

The second transporting belt 18 is disposed so that coins are transported along the surface of the guide member 7 in the second straight passage 11. Therefore, when the first coin sorting member 32 is located at the retracted position thereof where it is retracted from the second straight passage 11, since the surface of the first coin sorting member 32 is flush with the surface of the guide member 7 on the side of the second straight passage 11, coins pass by the first coin sorting and collecting opening 31 and are transported along the surface of the guide member 7 downward of the first coin sorting and collecting opening 31 in the second straight passage 11. To the contrary, when the first coin sorting member 32 is located at the projecting position located in the second straight passage 11, a coin transported along the surface of the guide member 7 is pushed by the first coin sorting member 32 to move apart from the guide member 7 so that one edge portion of the coin is located on the first coin sorting and collecting opening 31 and is dropped into the first coin sorting and collecting opening 31, thereby being collected.

A coin sensor 33 is provided in the second straight passage 11 immediately upstream of the first coin sorting member 32 of the first coin sorting and collecting means 30 and when the coin sensor 33 detects a coin to be dropped into the first coin sorting and collecting opening 31 and collected, the first coin sorting member 32 is driven and located at the projecting position thereof.

The first coin sorting and collecting opening 31 of the first coin sorting and collecting means 30 is connected to a first coin sorting and collecting box (not shown) via a chute (not shown) and coins dropped into the first coin sorting and collecting opening 31 are collected in the first coin sorting and collecting box via the chute and taken out to the outside of the coin wrapping machine.

A second coin sorting and collecting means 35 is provided in the second straight passage 11 downstream of the first coin sorting and collecting means 30. The second coin sorting and collecting means 35 includes a second coin sorting and collecting opening 36 formed in the coin passage surface 8 and a second coin sorting member 37 provided in a recess formed in the guide member 7.

The second coin sorting member 37 is rotatable about a vertical axis by a solenoid (not shown) between a projecting position located in the second straight passage 11 and a retracted position where it is retracted from the second straight passage 11 and is flush with the surface of the guide member 7 on the side of the second straight passage 11.

Similarly to the first coin sorting and collecting member 32, the distance between the surface of the guide member 7 on the side of the second straight passage 11 and the edge portion of the second coin sorting and collecting opening 36 on the side of the guide member 7 is shorter than a length of the second coin sorting member 37 located at the projecting position thereof and projecting from the surface of the guide member 7 but is enough to support one edge portion of a coin and guide the coin. The distance between the surface of the guide member 7 on the side of the second straight passage 11 and the edge portion of the second coin sorting and collecting opening 36 on the side of the guide member 6 is determined slightly smaller than the diameter of the smallest diameter coins to be handled.

The second transporting belt 18 is disposed so that coins are transported along the surface of the guide member 7 in the second straight passage 11. Therefore, when the second coin sorting member 37 is located at the retracted position thereof where it is retracted from the second straight passage 11, since the surface of the second coin sorting member 37 is flush with the surface of the guide member 7 on the side of the second straight passage 11, coins pass by the second coin sorting and collecting opening 36 and are transported along the surface of the guide member 7 downward of the second coin sorting and collecting opening 36 in the second straight passage 11. To the contrary, when the second coin sorting member 37 is located at the projecting position located in the second straight passage 11, a coin transported along the surface of the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected.

A coin sensor 38 is provided in the second straight passage 11 immediately upstream of the second coin sorting member 37 of the second coin sorting and collecting means 35 and when the coin sensor 38 detects a coin to be dropped into the second coin sorting and collecting opening 36 and collected, the second coin sorting member 37 is driven and located at the projecting position thereof The second coin sorting and collecting opening 36 of the second coin sorting and collecting means 35 is connected to a second coin sorting and collecting box (not shown) via a chute (not shown) and coins dropped into the second coin sorting and collecting opening 36 are collected in the second coin sorting and collecting box via the chute and taken out to the outside of the coin wrapping machine.

A magnetic sensor 40 is provided for detecting magnetic properties of coins in the second straight passage 11 downstream of the second coin sorting and collecting means 35.

On the opposite sides, a pair of coin sensors 41*a*, 41*b* are provided and when the pair of coin sensors 41*a*, 41*b* detect a coin, the magnetic sensor 40 outputs detected magnetic data of the coin as a detection signal.

When it is discriminated based on the magnetic data detected by the magnetic sensor 40 that the coin is an unacceptable coin or a coin having denomination other than a predetermined one, the operation of the coin wrapping machine is immediately stopped and a message indicating that an error occurred is displayed on a display portion (not shown) of the coin wrapping machine.

A third coin sorting and collecting means 45 is provided in the second curved passage 14 connected to the downstream end portion of the second straight passage 11. The third coin sorting and collecting means 45 includes a third coin sorting and collecting opening 46 formed in the coin passage surface 8 of the second curved passage 14 and a third coin sorting member 47 provided in a recess formed in the guide member 7.

The third coin sorting member 47 is rotatable about a vertical axis by a solenoid (not shown) between a projecting position located in the second curved passage 14 and a retracted position where it is retracted from the second curved passage 14 and is flush with the surface of the guide member 7 on the side of the second curved passage 14.

Similarly to the first coin sorting and collecting member 32 and the second coin sorting and collecting member 37, the distance between the surface of the guide member 7 on the side of the second curved passage 14 and the edge portion of the third coin sorting and collecting opening 46 on the side of the guide member 7 is shorter than the length of the third coin sorting member 47 located at the projecting position thereof and projecting from the surface of the guide member 7 but is enough to support one edge portion of a coin and guide the coin. The distance between the surface of the guide member 7 on the side of the second curved passage 14 and the edge portion of the third coin sorting and collecting opening 46 on the side of the guide member 6 is determined slightly smaller than the diameter of the smallest diameter coins to be handled.

The second transporting belt 18 is disposed so that coins are transported along the surface of the guide member 7 in the second curved passage 14. Therefore, when the third coin sorting member 47 is located at the retracted position thereof where it is retracted from the second curved passage 14, since the surface of the third coin sorting member 47 is flush with the surface of the guide member 7 on the side of the second curved passage 14, coins pass by the third coin sorting and collecting opening 46 and are transported along the surface of the guide member 7 downward of the third coin sorting and collecting opening 46 in the second curved passage 14. To the contrary, when the third coin sorting member 47 is located at the projecting position located in the second curved passage 14, a coin transported along the surface of the guide member 7 is pushed by the third coin sorting member 47 to move apart from the guide member 7 so that one edge portion of the coin is located on the third coin sorting and collecting opening 46 and is dropped into the third coin sorting and collecting opening 46, thereby being collected.

The coin wrapping machine according to this embodiment is constituted so as to be selectively operated in accordance with a counting mode under which the total number and/or total value of coins of a predetermined denomination is counted and a wrapping mode under which coins of a predetermined denomination are wrapped. In the case where the counting mode is selected, the third coin sorting member 47 is located at the projecting position thereof located in the second curved passage 14 so that all coins fed to the third coin sorting and collecting means 45 are pushed by the third coin sorting member 47 and dropped into the third coin sorting and collecting opening 46, thereby being sorted and collected.

On the other hand, in the case where the wrapping mode is selected, the operator further can select a first wrapping mode or a second wrapping mode. In the case where the first wrapping mode is selected, the third coin sorting member 47 is held at the retracted position thereof where it is retracted from the second curved passage 14 so that coins pass through the second curved passage 14 and are fed into the third straight passage 12 and in the case where the second wrapping mode is selected, only when the magnetic sensor 21 and the optical sensor 22 detect a specific coin, the third coin sorting member 47 is moved to the projecting position thereof, thereby dropping the specific coin into the coin sorting and collecting opening 46.

A coin sensor 50 is provided in the second curved passage 14 immediately upstream of the third coin sorting opening 46 of the third coin sorting and collecting means 45 and when the coin sensor 50 detects a coin to be dropped into the third coin sorting and collecting opening 46, the coin sorting member 46 is driven and located at the projecting position thereof.

A cylindrical coin guide member 48 is connected to the third coin sorting and collecting opening 46 and the lower end portion of the coin guide member 48 is connected to a chute 49 communicating with a coin take-out box (not shown). Therefore, coins dropped into the third coin sorting and collecting opening 46 are led into the coin take-out box (not shown) via the coin guide member 48 and the chute 49 and taken out from the coin wrapping machine to the outside thereof A pair of coin sensors 44*a*, 44*b* are provided at a downstream end portion of the third straight passage 12 whose upstream end portion is connected to the second curved passage 14 and are constituted so as to count the number of coins fed to the coin wrapping apparatus described below.

To the downstream end portion of the third straight passage 12, a coin wrapping apparatus 60 is connected for stacking a predetermined number of coins, wrapping them and producing a wrapped coin roll.

The coin wrapping apparatus 60 includes a coin stacking means 61 for stacking a predetermined number of coins and a coin wrapping means 62 for winding a wrapping film around a predetermined number of coins stacked by the coin stacking means 61 to wrap the stacked coins, thereby producing a wrapped coin roll.

As well known in the art, the coin stacking means 61 is provided with a pair of stacking drums 64, 64 synchronously rotatable in the opposite directions to each other and formed with spiral projections 63 on the peripheral surface thereof and a predetermined number of coins are stacked on the spiral projections 63 as the pair of stacking drums 64, 64 are rotated.

As well known in the art, the coin wrapping apparatus 62 includes a plurality of wrapping rollers (not shown) for a wrapping film to be wrapped around a predetermined number of coins stacked by the coin stacking means 61 and a crimping mechanism (not shown) provided with a pair of crimping claws for crimping upper and lower end portions of the wrapping film wound around the stacked coins.

Figure 3:
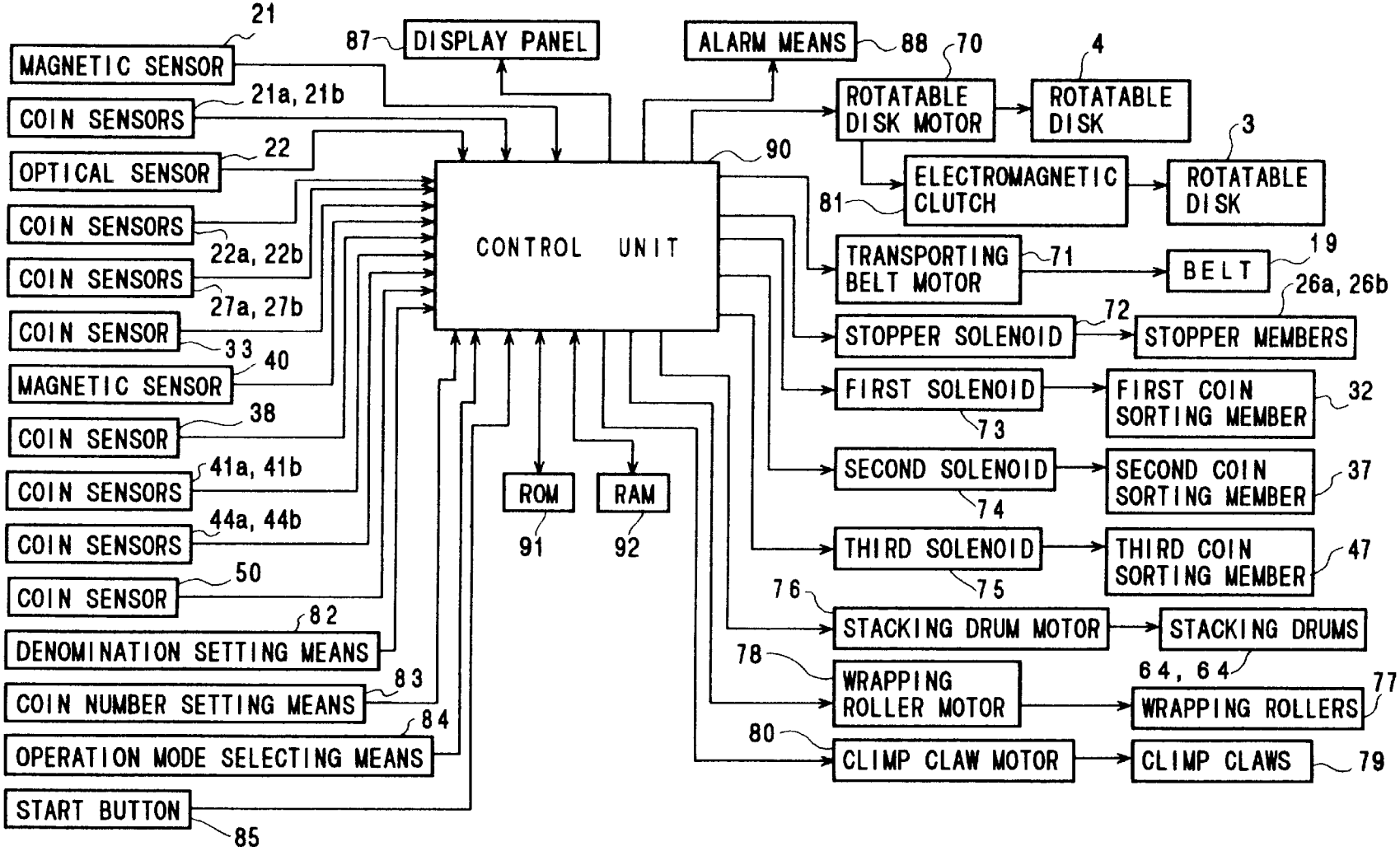
FIG. 3 is a block diagram of a detection system, a driving system, an input system and a control system of a coin wrapping machine which is a preferred embodiment of the present invention.

FIG. 3 is a block diagram of a detection system, a driving system, an input system and a control system of the coin wrapping machine which is a preferred embodiment of the present invention.

As shown in FIG. 3, the detection system of the coin wrapping machine according to this embodiment includes the magnetic sensor 21 provided in the first straight passage 10 for detecting magnetic properties of coins and outputting a detection signal, the pair of coin sensor 21*a*, 21*b* provided in the first straight passage 10 on the opposite sides of the magnetic sensor 21 for detecting coins and outputting a detection signal, the optical sensor 22 provided in the second straight passage 11 for detecting the diameter and the surface pattern of a coin and outputting a detection signal, the pair of coin sensors 22*a*, 22*b* in the second straight passage 11 on the opposite sides of the optical sensor 22 for detecting coins and outputting a detection signal, the pair of coin sensors 27*a*, 27*b* provided in the second straight passage 11 immediately upstream of the stopper members 26*a*, 26*a* for detecting coins and outputting a detection signal, the coin sensor 33 provided in the second straight passage 11 immediately upstream of the first coin sorting member 32 for detecting coins and outputting a detection signal, the coin sensor 38 provided in the second straight passage 11 immediately upstream of the second coin sorting member 37 for detecting coins and outputting a detection signal, the magnetic sensor 40 provided in the second straight passage 11 downstream of the second coin sorting and collecting means 35 for detecting magnetic properties of coins and outputting a detection signal, the pair of coin sensors 41*a*, 41*b* provided on the opposite sides of the magnetic sensor 40 for detecting coins and outputting a detection signal, the coin sensor 50 provided in the second curved passage 14 immediately upstream of the third coin sorting member 47 for detecting coins and outputting a detection signal, and the coin sensors 44*a*, 44*b* provided at the downstream end portion of the third straight passage 12 for detecting coins and outputting a detection signal.

As shown in FIG. 3, the drive system of the coin wrapping machine according to this embodiment includes a rotatable disk motor 70 for rotating the rotatable disk 3 and the rotatable disk 4, a transporting belt motor 71 for driving the first transporting belt 17 and the second transporting belt 18 via the belt 19, a stopper solenoid 72 for driving the pair of stopper members 26*a*, 26*b*, a first solenoid 73 for driving the first coin sorting member 32, a second solenoid 74 for driving the second coin sorting member 37, a third solenoid 75 for driving the third sorting member 47, a stacking drum motor 76 for driving the pair of stacking drums 64, 64, a wrapping roller motor 78 for driving a plurality of wrapping rollers 77, and a crimp claw motor 80 for driving an upper and lower pair of crimp claws 79.

A driving force of the rotatable disk motor 70 is transmitted via an electromagnetic clutch 81 to the rotatable disk 3 and coins are fed onto the rotatable disk 4 from the rotatable disk 3 by intermittently connecting the electromagnetic clutch 81 in accordance with the amount of coins on the rotatable disk 4.

As shown in FIG. 3, the input system of the coin wrapping machine according to this embodiment includes a denomination setting means 82 for setting the denomination of coins to be counted or wrapped, a coin number setting means 83 for setting the number of coins to be counted or wrapped, an operation mode selecting means 84 for selecting either the counting mode or the wrapping mode, and a start button 85 for causing the coin wrapping machine to start counting operation or wrapping operation.

As shown in FIG. 3, the display system of the coin wrapping machine according to this embodiment includes a display panel 87 for displaying the number of counted coins and other information and an alarm means 88 for generating an alarm when a coin is discriminated to be an unacceptable coin or a coin of a denomination other than a predetermined one based on the detection signal output by the magnetic sensor 40 provided in the second straight passage 11.

As shown in FIG. 3, the control system of the coin wrapping machine according to this embodiment includes a control unit 90 for controlling the overall operation of the coin wrapping machine, discriminating based on detection signals input from the magnetic sensor 21 and the optical sensor 22 whether or not a coin is acceptable and the denomination of the coin, counting coins, discriminating based on a detection signal input from the magnetic sensor 40 whether or not a coin is acceptable and the denomination of the coin, and outputting various instruction signals to the magnetic sensor 21, the optical sensor 22, the magnetic sensor 40, respective drive means constituting the drive system, the display panel 87 and the alarm means 88, a ROM 91 for storing a control program for controlling the overall operation of the coin wrapping machine, various reference data and the like, and a RAM 92 for storing the results of discrimination made by the control unit 90 and the like.

In this embodiment, the ROM 91 stores reference diameter data and reference surface pattern data of new issue coins and reference diameter data and reference surface pattern data of past issue circulating coins of the same denomination as that of the new issue coins.

Detection signals are input from the pair of coin sensors 21*a*, 21*b* to the control unit 90 and the control unit 90 is constituted to output an instruction signal to the magnetic sensor 21 in accordance with detection signals input from the pair of coin sensors 21*a*, 21*b*, thereby causing the magnetic sensor 21 to output detected magnetic properties of a coin as a detection signal and discriminate based on the detection signal input from the magnetic sensor 21 whether or not the coin is acceptable, the denomination of the coin and whether the coin is a new issue coin or a past issue circulating to write the results of discrimination in the RAM 92.

Further, detection signals are input from the pair of coin sensors 22*a*, 22*b* to the control unit 90 and the control unit 90 is constituted to output an instruction signal to the optical sensor 22 in accordance with the detection signals input from the pair of coin sensors 22*a*, 22*b*, thereby causing the optical sensor 22 to output the detected diameter and surface pattern as a detection signal and discriminate based on the detection signal input from the optical sensor 22 whether or not the coin is acceptable, the denomination of the coin and whether the coin is a new issue coin or past issue circulating old coin. The control unit 90 further compares the results of discrimination with the results of discrimination made based on the detection signal of the magnetic sensor 21 and written in the RAM 92 to finally discriminate whether or not the coin is acceptable, the denomination of the coin and whether the coin is a new issue coin or past issue circulating old coin, and count coins of denomination input through the denomination setting means 82 or new issue coins and/or past issue circulating old coins of the denomination input through the denomination setting means 82 to write the result of discrimination and the count value of coins in the RAM 92.

Detection signals from the pair of coin sensors 27*a*, 27*b*, a detection signal from the coin sensor 33, a detection signal from the coin sensor 38, a detection signal from the coin sensor 50 and detection signals from the pair of coin sensors 41*a*, 41*b* are further input to the control unit 90.

Detection signals are further input from the pair of coin sensors 44*a*, 44*b* to the control unit 90 and the control unit 90 counts the number of coins fed into the coin wrapping apparatus 60 based on the detection signals input from the pair of coin sensors 44*a*, 44*b* and stores the counted value of the coin in the RAM 92.

In the case where coins of the same denomination as that of past issue circulating coins are newly issued, the thus constituted coin wrapping machine according to this embodiment wraps only the new issue coins while it is separately collecting the past issue circulating coins and produces a wrapped coin roll.

Figure 4:
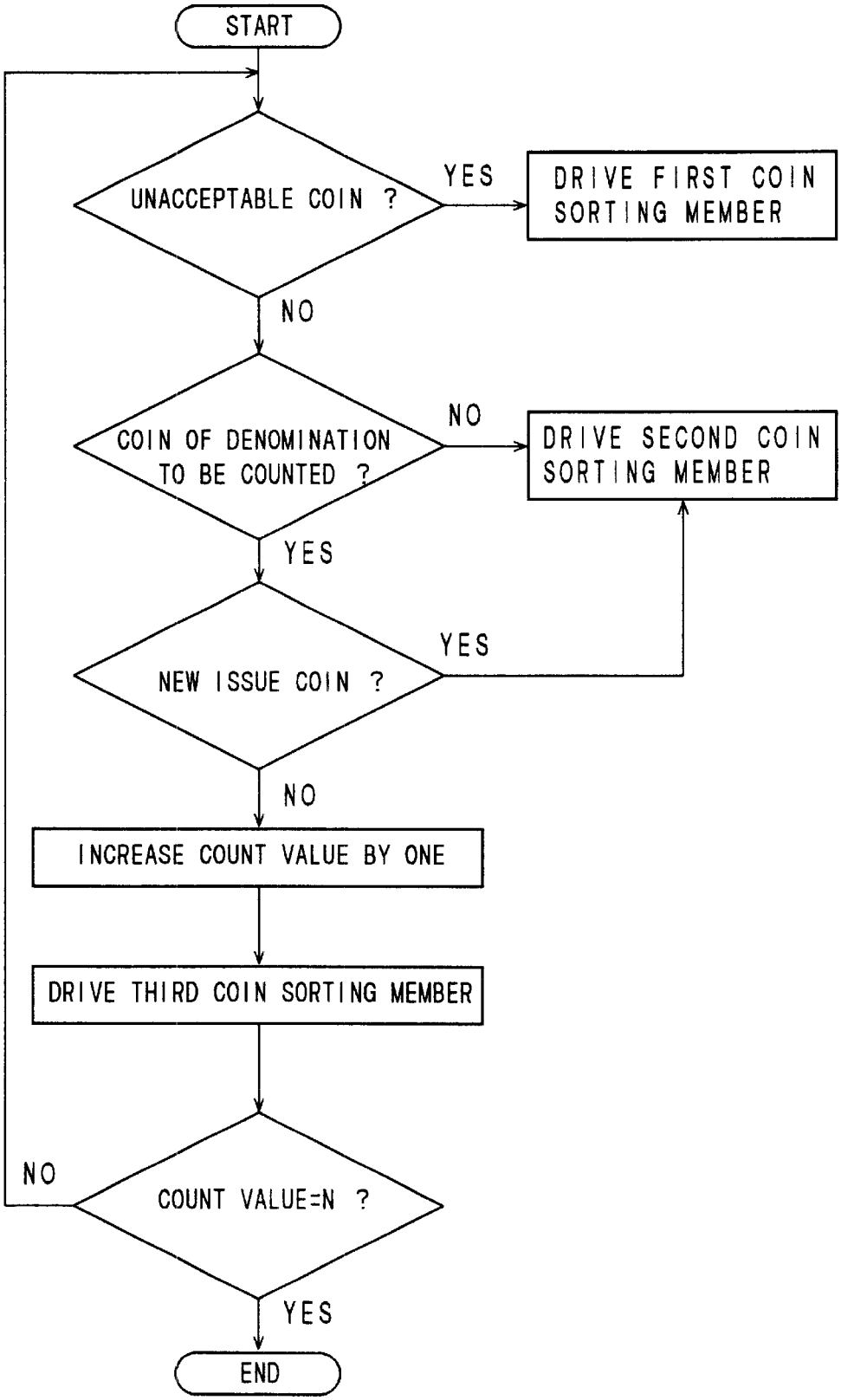
FIG. 4 is a flow chart showing an operation for counting and collecting past issue circulating old coins in a preferred embodiment of the present invention in order to wrap only new issue coins.

FIG. 4 is a flow chart showing an operation for counting and collecting past issue circulating old coins in a preferred embodiment of the present invention in order to wrap only new issue coins.

The denomination setting means 82 is first operated by the operator to input the denomination of new issue coins as the denomination of coins to be wrapped.

The denomination setting signal input through the denomination setting means 82 is output to the control unit 90 and the control unit 90 writes the denomination of coins to be wrapped in the RAM 92 in accordance with the denomination setting signal.

The operation mode selecting means 84 is then operated by the operator to select a counting mode and the coin number setting means 83 is operated by the operator to set a unit count number of the past issue circulating old coins to be counted by one counting operation. The unit count number may be set to be, for example, 500, 1,000, 2,000, 3,000, 4,000.

When a counting mode selecting signal is input through the operation mode selecting means 84, the control unit 90 outputs a projection signal to the third solenoid 75, thereby causing it to locate the third coin sorting member 47 at the projecting position where the third coin sorting member 47 projects into the second curved passage 14.

A unit count number setting signal is input through the coin number setting means 83 to the control unit 90 and the control unit 90 writes the unit count number specified by the unit count number setting signal in the RAM 92, thereby storing it therein.

When the start button 85 is operated by the operator, a start signal is input to the control unit 90. The control unit 90 outputs drive signals to the rotatable disk motor 70 and the transporting belt motor 71, thereby rotating the rotatable disk 3 and the rotatable disk 4 and driving the first transporting belt 17 and the second transporting belt 18.

Coins deposited into the coin depositing opening 2 by the operator are fed onto the rotatable disk 3 disposed below the coin depositing opening 2 and fed one by one onto the rotatable disk 4 by centrifugal force produced by the rotation of the rotatable disk 3.

Coins fed onto the rotatable disk 4 are fed one by one via the coin separating member (not shown) into the coin passage 5 by centrifugal force produced by the rotation of the rotatable disk 4. At this time, since the clearance is formed between the coin separating member and the upper surface of the rotatable disk 4 so as to be greater than the thickness of the thickest coins to be handled and smaller than double the thickness of the thinnest coins to be handled, it is ensured that coins are fed out one by one into the coin passage 5.

When a coin fed into the coin passage 5 is detected by the pair of coin sensor 21*a*, 21*b* provided in the first straight passage 10, a detection signal is output to the control unit 90.

When the control unit 90 receives the detection signal from the pair of coin sensor 21*a*, 21*b*, it outputs an instruction signal to the magnetic sensor 21 and causes the magnetic sensor to output magnetic properties detected thereby at the time as a magnetic data detection signal.

When the magnetic properties of the coin are detected by the magnetic sensor 21 and the magnetic data detection signal is input from the magnetic sensor 21 to the control unit 90, the control unit 90 reads reference magnetic data of each denomination of coins stored in the ROM 91 and compares them with the magnetic data of the coin detected by and input from the magnetic sensor 21, thereby discriminating whether or not the coin is acceptable. When the control unit 90 determines that the coin is acceptable, it discriminates the denomination of the coin and whether or not the denomination of the coin coincides with the denomination of coins to be counted. When the denomination of the coin coincides with the denomination of coins to be counted, the control unit 90 further discriminates whether the coin is a new issue coin or a past issue circulating old coin and writes the results of discrimination in the RAM 92.

The coin is further transported by the first transporting belt 17 in the coin passage 5 and when the pair of coin sensors 22*a*, 22*b* detects the coin fed into the second straight passage 11 from the first straight passage 10 via the first curved passage 13, a detection signal is output to the control unit 90.

When the control unit 90 receives the detection signal from the pair of coin sensors 22*a*, 22*b*, it outputs an instruction signal to the optical sensor 22, thereby causing the optical sensor 22 to output the optical properties of the coin, namely, the diameter and the surface pattern of the coin detected thereby at the time as an optical data detection signal.

When the diameter and the surface pattern of the coin are detected by the optical sensor 22 and the optical data detection signal is input from the optical sensor 22 to the control unit 90, the control unit 90 reads reference diameter data and reference surface pattern data of each denomination of coins stored in the ROM 91 and compares them with the diameter data and the surface pattern data of the coin detected by and input from the optical sensor 22, thereby discriminating whether or not the coin is acceptable. When the control unit 90 determines that the coin is acceptable, it discriminates the denomination of the coin and whether or not the denomination of the coin coincides with the denomination of coins to be counted. When the denomination of the coin coincides with the denomination of coins to be counted, the control unit 90 further discriminates whether the coin is a new issue coin or a past issue circulating old coin.

When the control unit 90 discriminates that the coin is unacceptable, it writes the results of discrimination in the RAM 92.

On the other hand, when the control unit 90 discriminates in accordance with the diameter data and the surface pattern data of the coin detected by the optical sensor 22 that the coin is an acceptable coin, it further reads the result of discrimination made based on the magnetic data detected by the magnetic sensor 21 and written in the RAM 92.

When the coin was discriminated unacceptable based on the magnetic data detected by the magnetic sensor 21, the control unit 90 finally discriminates that the coin is unacceptable irrespective of the result of discrimination made based on the diameter data and the surface pattern data of the coin detected by the optical sensor 22 and writes the result of the final discrimination in the RAM 92.

To the contrary, when the coin was discriminated acceptable based on the magnetic data detected by the magnetic sensor 21 and the denomination of the discriminated coin has been written in the RAM 92, the control unit 90 compares the result of discrimination written in the RAM 92 with the result of discrimination made based on the diameter data and the surface pattern data of the coin detected by the optical sensor 22.

When the denomination of the coin discriminated based on the diameter data and the surface pattern data of the coin detected by the optical sensor 22 does not coincide with the denomination of the coin discriminated based on the magnetic data detected by the magnetic sensor 21, the control unit 90 finally discriminates that the coin is an unacceptable coin and writes the result of final discrimination in the RAM 92.

To the contrary, when the denomination of the coin discriminated based on the diameter data and the surface pattern data of the coin detected by the optical sensor 22 coincides with the denomination of the coin discriminated based on the magnetic data detected by the magnetic sensor 21, the control unit further discriminates whether or not the denomination of the coin coincides with the denomination of coins to be counted.

When the denomination of the coin does not coincide with the denomination of coins to be counted, the control unit 90 writes the finally discriminated denomination of the coin in the RAM 92.

On the other hand, when the denomination of the coin coincides with the denomination of coins to be counted, the control unit 90 further discriminates whether the coin is a new issue coin or a past issue circulating old coin and compares the result of discrimination with the result of discrimination made based on the magnetic data detected by the magnetic sensor 21 and written in the RAM 92.

When the result of discrimination made based on the magnetic data detected by the magnetic sensor 21 and written in the RAM 92 does not coincide with the result of discrimination made based on the optical data detected by the optical sensor 22, the control unit 90 finally discriminates that the coin is an unacceptable coin and writes the result of final discrimination in the RAM 92.

To the contrary, when the result of discrimination made based on the magnetic data detected by the magnetic sensor 21 and written in the RAM 92 coincides with the result of discrimination made based on the optical data detected by the optical sensor 22, the control unit 90 writes the result of final discrimination as to whether the coin is a new issue coin or a past issue circulating old coin in the RAM 92 and when the control unit 90 discriminates that the coin is a past issue circulating old coin, it overwrites the count value of coins stored in the RAM 92 to increase it by one.

When the control unit 90 discriminates that the coin is unacceptable, at the time the coin sensor 33 detects the coin and a detection signal is input from the coin sensor 33, the control unit 90 outputs a drive signal to the first solenoid 73 for driving the first coin sorting member 32, thereby rotating the first coin sorting member 32 to be located at the projecting position thereof As a result, the unacceptable coin transported along the guide member 7 is pushed by the first coin sorting member 32 to move apart from the guide member 7 so that one edge portion of the coin is located on the first coin sorting and collecting opening 31 and is dropped into the first coin sorting and collecting opening 31, thereby being collected in the first coin sorting and collecting box (not shown) via the chute (not shown).

To the contrary, when the control unit 90 discriminates that the coin is acceptable, it does not output a drive signal to the first solenoid 73 and, therefore, since the first coin sorting member 32 is kept at the retracted position thereof where it is retracted from the second straight passage 11, the coin passes by the first coin sorting and collecting opening 31 and is fed along the guide member 7 toward the downstream of the first coin sorting and collecting opening 31 in the second straight passage 11.

On the other hand, when the control unit 90 discriminates that the coin is acceptable but the denomination thereof does not coincide with the denomination of coins to be counted, or that the denomination of the coin coincides with the denomination of coins to be counted but the coin is a new issue coin, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof As a result, the coin transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown).

In this manner, all of coins of denominations different from that of coins to be counted and coins of the denomination to be counted but newly issued are dropped into the second coin sorting and collecting opening 36 and collected in the second coin sorting and collecting box (not shown) via the chute (not shown).

To the contrary, in the case where the coin is a coin of the denomination to be counted and a past issue circulating old coin, the control unit 90 does not output a drive signal to the second solenoid 74 and, therefore, since the second coin sorting member 37 is kept at the retracted position thereof where it is retracted from the second straight passage 11, the past issue circulating old coin of the denomination to be counted passes by the second coin sorting and collecting opening 36 and is fed along the guide member 7 toward the downstream of the second coin sorting and collecting opening 36 in the second straight passage 11.

When the coin is detected by the pair of coin sensors 41*a*, 41*b* provided in the second straight passage 11 downstream of the second coin sorting and collecting opening 36, a detection signal is output to the control unit 90.

When the control unit 90 receives the detection signal from the pair of coin sensors 41*a*, 41*b*, it outputs an instruction signal to the magnetic sensor 40 and causes the magnetic sensor 40 to output the magnetic data of the coin detected thereby at the time as a magnetic data detection signal.

When the magnetic properties of the coin are detected by the magnetic sensor 40 and the magnetic data detection signal is input from the magnetic sensor 40 to the control unit 90, the control unit 90 reads reference magnetic data of past issue circulating old coins of the denomination to be counted and stored in the ROM 91 and compares them with the magnetic data of the coin detected by and input from the magnetic sensor 40, thereby discriminating whether or not the coin is a past issue circulating old coin of the denomination to be counted.

As a result, when the control unit 90 discriminates based on the detection signal input from the magnetic sensor 40 that the coin is not a past issue circulating old coin of the denomination to be counted, it judges that the coin has been erroneously discriminated and outputs drive stop signals to the rotatable disk motor 70 and the transporting belt motor 71, thereby stopping the rotation of the rotatable disk 3 and the rotatable disk 4 and the driving the first transporting belt 17 and the second transporting belt 18.

At the same time, the control unit 90 outputs an error signal to the display panel 87, thereby causing it to display a message indicating that an error has occurred and outputs an alarm signal to the alarm means 88, thereby causing it to produce an alarm.

Therefore, the operator can recognize the fact that an error has occurred and open the coin wrapping machine and remove the coin or coins causing the error, whereafter the counting operation of coins can be restarted.

To the contrary, when the control unit 90 discriminates based on the detection signal input from the magnetic sensor 40 that the coin is a past issue circulating old coin of the denomination to be counted, it does not output any signal and, therefore, the coin passes through the magnetic sensor 40 and is fed from the second straight passage 11 to the second curved passage 14.

In this embodiment, in the case where a counting mode is selected, since the third coin sorting member 47 is located at the projecting position where it projects in the second curved passage 14, every past issue circulating old coin of the same denomination as that of new issue coins is pushed by the third coin sorting member 47 so that the one edge portion thereof is located on the third coin sorting and collecting opening 46 and the coin is dropped into the third coin sorting and collecting opening 46, thereby being collected in the coin take-out box (not shown) via the cylindrical coin guide member 48 and the chute 49.

In this manner, when the control unit 90 judges that the count value of past issue circulating old coins of the denomination stored in the RAM 92 has become equal to the unit count number N by which coins are to be counted in one counting operation and which is set through the coin number setting means 83 and stored in the RAM 92, the control unit 90 outputs a drive signal at a predetermined time to the stopper solenoid 72 for driving the pair of stopper members 26*a*, 26*b*, thereby causing it to rotate the pair of stopper members 26*a*, 26*b* to be located in the projecting position thereof As a result, the coin following the Nth past issue circulating old coin of the denomination to be counted detected by the optical sensor 22 is stopped by the pair of stopper members 26*a*, 26*b* to be prevented from being transported.

When the magnetic sensor detects the Nth past issue circulating old coin of the denomination to be counted and a detection signal is input to the control unit 90, the control unit 90 outputs reverse drive signals to the rotatable disk motor 70 and the transporting belt motor 71, thereby rotating the rotatable disk 3 and the rotatable disk 4 in the reverse direction and driving the first transporting belt 17 and the second transporting belt 18 in the reverse direction so as to return a coin fed into the coin passage 5 from the rotatable disk 4 and following the Nth old coin back onto the rotatable disk 4.

When a predetermined time period has passed after the magnetic sensor 21 provided in the first straight passage 10 detected the last coin, the control unit 90 terminates one cycle of the counting operation of coins.

When it is judged based on the detection signals from the magnetic sensor 21 and the optical sensor 22 that coins which have not been counted remain on the rotatable disk 4, the operator again operates the start button 85 to cause the coin wrapping machine to conduct the next cycle of the coin counting operation.

When, after repeating counting cycles of coins in this manner, a predetermined time period passes after the optical sensor 22 detected the last coin during the counting operation of coins of a certain denomination, even though the pair of stopper members 26*a*, 26*b* were not driven, the control unit 90 judges that all coins deposited into the coin depositing opening 2 were fed into the coin passage 5 and detected by the optical sensor 22 before the count value of past issue circulating old coins of the same denomination as that of coins to be counted, which is stored in the RAM 92, became equal to the predetermined number N and immediately terminates the counting operation of coins.

As a result, all past issue circulating old coins to be counted are led via the third coin sorting and collecting opening 46, the cylindrical coin guide member 48 and the chute 49 to the coin take-out box (not shown) and collected. On the other hand, coins of denominations different from that of coins to be counted and new issue coins of the same denomination as that of coins to be counted are collected in the second coin sorting and collecting box (not shown) via the second coin sorting and collecting opening 36 and the chute (not shown). Therefore, past issue circulating old coins can be collected separately from new issue coins.

When the counting operation of coins is completed in this manner, coins collected in the second coin sorting and collecting box are again deposited into the coin deposited opening 2 and new issue coins will be wrapped in the following manner.

Figure 5:
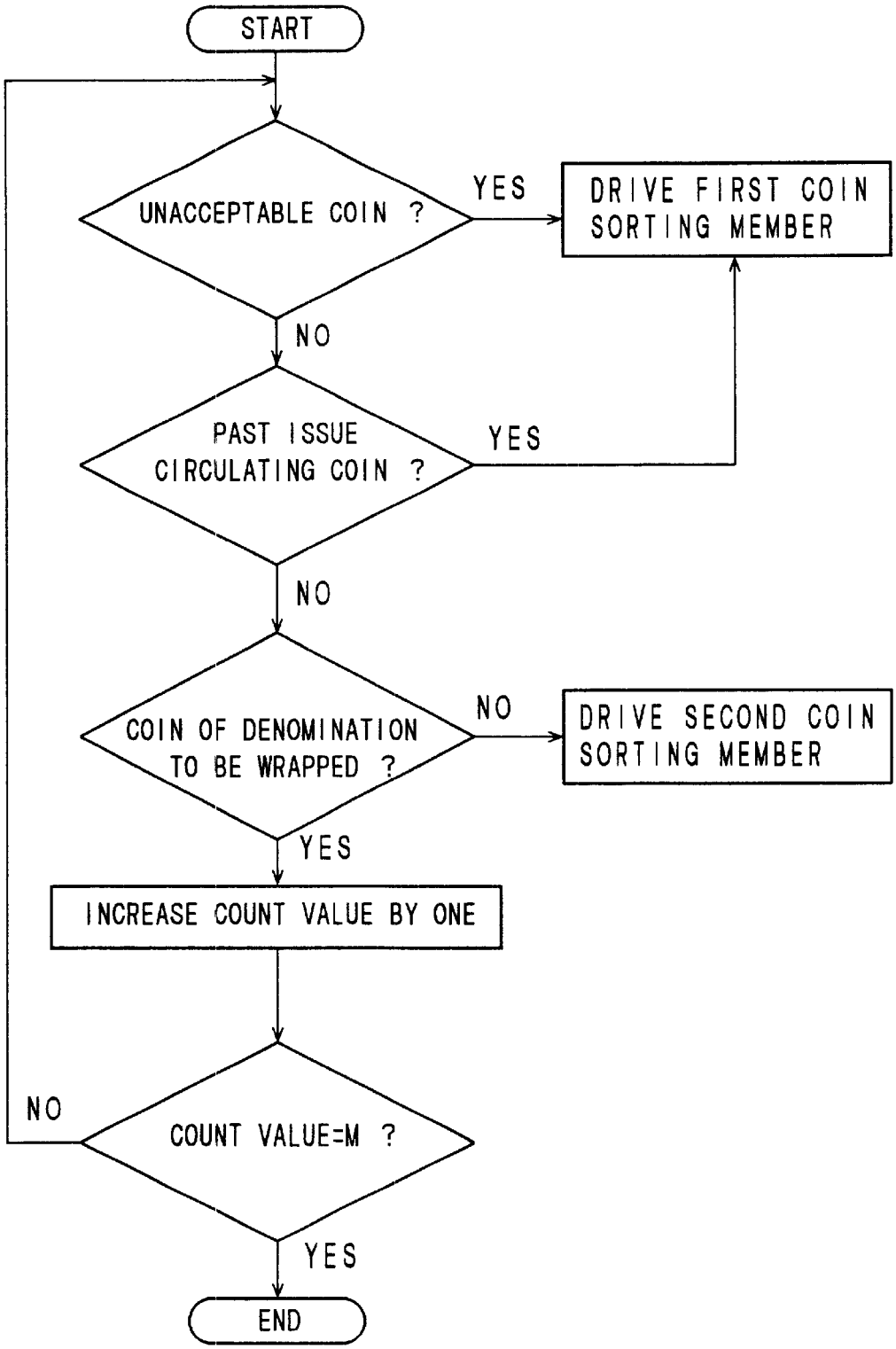
FIG. 5 is a flow chart showing an operation for again depositing coins collected in a second coin sorting and collecting box into a coin depositing opening and wrapping new issue coins to produce a wrapped coin roll when a first wrapping mode is selected.

FIG. 5 is a flow chart showing an operation for again depositing coins collected in the second coin sorting and collecting box into the coin depositing opening 2 and wrapping new issue coins to produce a wrapped coin roll when a first wrapping mode is selected.

The denomination setting means 82 is first operated by the operator and the denomination of new issue coins is input as the denomination of coins to be wrapped.

A denomination setting signal input through the denomination setting means 82 is output to the control unit 90 and the control unit 90 writes the denomination of coins to be wrapped in the RAM 92 in accordance with the denomination setting signal.

The operation mode selecting means 84 is then operated by the operator to select wrapping mode and further select first wrapping mode and the coin number setting means 83 is operated to set the wrapping number M of coins forming a single wrapped coin roll.

When a first wrapping mode selection signal is input from the operation mode selecting means 84, the control unit 90 outputs a retraction signal to the third solenoid 75, thereby causing it to move the third coin sorting member 47 to the retracted position thereof.

A wrapping number setting signal is input from the coin number setting means 83 to the control unit 90 and the control unit 90 writes the wrapping number M of coins instructed by the wrapping number setting signal in the RAM 92 and stores it therein.

Coins collected in the second coin sorting and collecting box are again deposited by the operator into the coin depositing opening 2 and when the start button 85 is operated, a start signal is input to the control unit 90 and the control unit 90 outputs drive signals to the rotatable disk motor 70 and the transporting belt motor 71, thereby rotating the rotatable disk 3 and the rotatable disk 4 and driving the first transporting belt 17 and the second transporting belt 18.

The coins deposited into the coin deposited opening 2 by the operator are fed onto the rotatable disk 3 provided below the coin deposited opening 2 and are fed one by one by centrifugal force produced by the rotation of the rotatable disk 3 onto the rotatable disk 4.

The coins fed onto the rotatable disk 4 are fed one by one into the coin passage 5 via the coin separating member (not shown) by centrifugal force produced by the rotation of the rotatable disk 4. A coin fed into the coin passage 5 is detected by the pair of coin sensors 21*a*, 21*b* provided in the first straight passage 10, and detection signals are output to the control unit 90.

When the control unit 90 receives the detection signals from the pair of coin sensors 21*a*, 21*b*, it outputs an instruction signal to the magnetic sensor 21, thereby causing the magnetic sensor 21 to output magnetic properties of a coin detected thereby at the time as a magnetic data detection signal.

When the magnetic properties of the coin are detected by the magnetic sensor 21 and the magnetic data detection signal is input from the magnetic sensor 21 to the control unit 90, the control unit 90 reads reference magnetic data of each denomination of coins stored in the ROM 91 and compares them with the magnetic data of the coin detected by and input from the magnetic sensor 21, thereby discriminating whether or not the coin is acceptable. When the control unit 90 determines that the coin is acceptable, it discriminates the denomination of the coin and whether or not the denomination of the coin coincides with the denomination of coins to be counted. As a result, when the denomination of the coin coincides with the denomination of coins to be counted, the control unit 90 further discriminates whether the coin is a new issue coin or a past issue circulating old coin and writes the results of discrimination in the RAM 92.

During the counting operation under the counting mode, since unacceptable coins have been already collected in the first coin sorting and collecting box (not shown) and past issue circulating old coins of the denomination to be counted have been led and collected into the coin take-out box (not shown) via the third coin sorting and collecting opening 46, the cylindrical coin guide member 48 and the chute 49, unacceptable coins or past issue circulating old coins of the denomination to be counted cannot be detected in the wrapping operation of coins. Nevertheless, if a coin should be discriminated unacceptable or if a coin should be discriminated to be a past issue circulating old coin of the denomination to be counted, the control unit 90 determines that it is unacceptable.

The coin discrimination is made by the control unit 90 in this manner and the result of discrimination is written in the RAM 92 by the control unit 90.

The coin is further transported by the first transporting belt 17 in the coin passage 5 and when the pair of coin sensors 22*a*, 22*b* detects the coin fed into the second straight passage 11 from the first straight passage 10 via the first curved passage 13, a detection signal is output to the control unit 90.

When the control unit 90 receives the detection signal from the pair of coin sensors 22*a*, 22*b*, it outputs an instruction signal to the optical sensor 22, thereby causing the optical sensor 22 to output the optical properties of the coin, namely, the diameter and the surface pattern of the coin detected thereby at the time as an optical data detection signal.

When the diameter and the surface pattern of the coin are detected by the optical sensor 22 and the optical data detection signal is input from the optical sensor 22 to the control unit 90, the control unit 90 reads reference diameter data and reference surface pattern data of each denomination of coins stored in the ROM 91 and compares them with the diameter data and the surface pattern data of the coin detected by and input from the optical sensor 22, thereby discriminating whether or not the coin is acceptable. When the control unit 90 determines that the coin is acceptable, it discriminates the denomination of the coin and whether or not the denomination of the coin coincides with the denomination of coins to be counted. When the denomination of the coin coincides with the denomination of coins to be counted, the control unit 90 further discriminates whether the coin is a new issue coin or a past issue circulating old coin.

When the control unit 90 discriminates that the coin is unacceptable, it writes the results of discrimination in the RAM 92.

On the other hand, when the control unit 90 discriminates in accordance with the diameter data and the surface pattern data of the coin detected by the optical sensor 22 that the coin is an acceptable coin, it further reads the result of discrimination made based on the magnetic data detected by the magnetic sensor 21 and written in the RAM 92.

When the coin was discriminated unacceptable based on the magnetic data detected by the magnetic sensor 21, the control unit 90 finally discriminates that the coin is unacceptable irrespective of the result of discrimination made based on the diameter data and the surface pattern data of the coin detected by the optical sensor 22 and writes the result of the final discrimination in the RAM 92.

To the contrary, when the coin was discriminated acceptable based on the magnetic data detected by the magnetic sensor 21 and the denomination of the discriminated coin has been written in the RAM 92, the control unit 90 compares the result of discrimination written in the RAM 92 with the result of discrimination made based on the diameter data and the surface pattern data of the coin detected by the optical sensor 22.

When the denomination of the coin discriminated based on the diameter data and the surface pattern data of the coin detected by the optical sensor 22 does not coincide with the denomination of the coin discriminated based on the magnetic data detected by the magnetic sensor 21, the control unit 90 finally discriminates that the coin is an unacceptable coin and writes the result of final discrimination in the RAM 92.

To the contrary, when the denomination of the coin discriminated based on the diameter data and the surface pattern data of the coin detected by the optical sensor 22 coincides with the denomination of the coin discriminated based on the magnetic data detected by the magnetic sensor 21, the control unit further discriminates whether or not the denomination of the coin coincides with the denomination of coins to be counted.

When the denomination of the coin does not coincide with the denomination of coins to be counted, the control unit 90 writes the finally discriminated denomination of the coin in the RAM 92.

On the other hand, when the denomination of the coin coincides with the denomination of coins to be counted, the control unit 90 further discriminates whether the coin is a new issue coin or a past issue circulating coin.

Past issue circulating coins of the denomination were collected in the counting operation and even if some should have remained uncollected, they were discriminated unacceptable by the discrimination based on the magnetic data detected by the magnetic sensor 21. Therefore, if the coin is discriminated to be a past issue circulating coin, since there is high possibility of the coin being erroneously discriminated for some reason, the control unit 90 discriminates that the coin is unacceptable and writes the result of discrimination in the RAM 92.

To the contrary, when the control unit 90 discriminates that the coin is a new issue coin, since the coin was discriminated to be a new issue coin of the denomination to be counted based on the magnetic data detected by the magnetic sensor 21, the control unit 90 finally discriminates without comparing the result of discrimination with the result of discrimination made based on the magnetic data detected by the magnetic sensor 21 and written in the RAM 92 that the coin is a new issue coin to write the result of discrimination in the RAM 92 and overwrites the count value of coins by increasing the count value of coins to be wrapped and stored in the RAM 92 by one.

When the control unit 90 discriminates that the coin is unacceptable, at the time the coin sensor 33 detects the coin and a detection signal is input from the coin sensor 33, the control unit 90 outputs a drive signal to the first solenoid 73 for driving the first coin sorting member 32, thereby rotating the first coin sorting member 32 to be located at the projecting position thereof As a result, the unacceptable coin transported along the guide member 7 is pushed by the first coin sorting member 32 to move apart from the guide member 7 so that one edge portion of the coin is located on the first coin sorting and collecting opening 31 and is dropped into the first coin sorting and collecting opening 31, thereby being collected in the first coin sorting and collecting box (not shown) via the chute (not shown).

Therefore, unacceptable coins such as counterfeit coins and foreign coins and past issue circulating old coins which have erroneously not been collected in the counting operation are collected in the first coin sorting and collecting box.

To the contrary, when the control unit 90 discriminates that the coin is acceptable, it does not output a drive signal to the first solenoid 73 and, therefore, since the first coin sorting member 32 is kept at the retracted position thereof where it is retracted from the second straight passage 11, the coin passes by the first coin sorting and collecting opening 31 and is fed along the guide member 7 toward the downstream of the first coin sorting and collecting opening 31 in the second straight passage 11.

On the other hand, when the control unit 90 discriminates that the coin is acceptable but the denomination thereof does not coincide with the denomination of coins to be counted, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof.

As a result, the coin having the denominations different from that of coins to be wrapped and transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown).

Therefore, only coins which are acceptable but whose denominations are different from that of coins to be wrapped are collected in the second coin sorting and collecting box.

To the contrary, in the case where the coin is a new issue coin of the denomination to be wrapped, the control unit 90 does not output a drive signal to the second solenoid 74 and, therefore, since the second coin sorting member 37 is kept at the retracted position thereof where it is retracted from the second straight passage 11, a new issue coin of the denomination to be wrapped passes by the second coin sorting and collecting opening 36 and is fed along the guide member 7 toward the downstream of the second coin sorting and collecting opening 36 in the second straight passage 11.

When the coin is detected by the pair of coin sensors 41*a*, 41*b* provided in the second straight passage 11 downstream of the second coin sorting and collecting opening 36, a detection signal is output to the control unit 90.

When the control unit 90 receives the detection signal from the pair of coin sensors 41*a*, 41*b*, it outputs an instruction signal to the magnetic sensor 40 and causes the magnetic sensor 40 to output the magnetic data of the coin detected thereby at the time as a magnetic data detection signal.

When the magnetic properties of the coin are detected by the magnetic sensor 40 and the magnetic data detection signal is input from the magnetic sensor 40 to the control unit 90, the control unit 90 reads reference magnetic data of new issue coins of the denomination to be wrapped stored in the ROM 91 and compares them with the magnetic data of the coin detected by and input from the magnetic sensor 40, thereby discriminating whether or not the coin is a new issue coin of the denomination to be wrapped.

As a result, when the control unit 90 discriminates based on the detection signal input from the magnetic sensor 40 that the coin is not a new issue coin of the denomination to be wrapped, it judges that the coin has been erroneously discriminated and outputs drive stop signals to the rotatable disk motor 70 and the transporting belt motor 71, thereby stopping the rotation of the rotatable disk 3 and the rotatable disk 4 and stopping the driving the first transporting belt 17 and the second transporting belt 18.

At the same time, the control unit 90 outputs an error signal to the display panel 87, thereby causing it to display a message indicating that an error has occurred and outputs an alarm signal to the alarm means 88, thereby causing it to produce an alarm.

To the contrary, when the control unit 90 discriminates based on the detection signal input from the magnetic sensor 40 that the coin is a new issue coin of the denomination to be wrapped, it does not output any signal and, therefore, the coin passes through the magnetic sensor 40 and is fed from the second straight passage 11 to the second curved passage 14.

In this embodiment, in the case where a first wrapping mode is selected, since the third coin sorting member 47 is kept at the retracted position where it is retracted from the second curved passage 14, coins transported into the second curved passage 14 pass by the third coin sorting and collecting opening 46 and are fed to the third straight passage 12 and when a coin is detected by the pair of coin sensors 44*a*, 44*b* provided at the downstream end portion of the third straight passage 12, detection signals are output to the control unit 90.

When the control unit 90 receives the detection signals from the pair of coin sensors 44*a*, 44*b*, it overwrites the wrapping number count value of coins stored in the RAM 92 by increasing it by one.

Coins are further fed into the coin wrapping apparatus 60 and are supported on the spiral projections 63 formed on the peripheral surfaces of the pair of stacking drums 64, 64 of the coin stacking means 61.

As well known in the art, the pair of stacking drums 64, 64 of the coin stacking means 6.1 are intermittently rotated by the stacking drum motor 76 each time a coin to be wrapped is fed into the coin wrapping apparatus 60, thereby stacking coins on the spiral projections 63 formed on the peripheral surfaces thereof When the control unit 90 judges based on the count value and wrapping number count value of coins stored in the RAM 92 that coins to be wrapped whose number is equal to the wrapping number M of coins necessary for producing a single wrapped coin roll set by the operator by operating the coin number setting means 83 have passed through the pair of stopper members 26*a*, 26*b*, it outputs drive signals at a predetermined time to the stopper solenoid 72 for driving the pair of stopper members 26*a*, 26*b*, thereby causing it to rotate the pair of stopper members 26*a*, 26*b* to be located the projecting position thereof As a result, the coin following the Mth new issue coin having the denomination to be wrapped and passing through the pair of stopper members 26*a*, 26*b* is stopped by the pair of stopper members 26*a*, 26*b* to be prevented from being transported.

The control unit 90 further outputs reverse drive signals to the rotatable disk motor 70 and the transporting belt motor 71, thereby rotating the rotatable disk 3 and the rotatable disk 4 in the reverse direction and driving the first transporting belt 17 and the second transporting belt 18 in the reverse direction so as to return a coin fed into the coin passage 5 from the rotatable disk 4 and following the Mth new issue coin back onto the rotatable disk 4.

In this manner, when coins whose number is equal to the wrapping number M of coins necessary for producing a single wrapped coin roll have been stacked by the pair of stacking drums 64, 64 of the coin stacking means 61, as well known in the art, the stacked coins are delivered onto a shutter (not shown) and further delivered onto the upper surface of the coin support post 65 located at the waiting position thereof immediately below the shutter.

Further, as well known in the art, the stacked coins are moved to a wrapping position between a plurality of wrapping rollers 77, while they are being supported on the upper surface of the coin support post 65. The wrapping roller motor 78 is then driven by the control unit 90 to wind a wrapping film around the stacked coins and the crimping claw motor 80 is driven to crimp the upper and lower end portions of the wrapping film wound around the stacked coins by the pair of upper and lower crimping claw 79, thereby producing a wrapped coin roll.

According to the above described embodiment, past issue circulating old coins of the same denomination as that of new issue coins are led to and collected in the coin take-out box (not shown) via the third coin sorting and collecting opening 46, the cylindrical coin guide member 48 and the chute 49 by utilizing a counting mode function provided in a conventional coin wrapping machine for only counting coins. Therefore, past issue circulating old coins of the same denomination as that of new issue coins can be reliably sorted and efficiently collected without providing any special mechanism.

Further, according to the above described embodiment, in the operation under the counting mode, all coins having denominations different from that of coins to be wrapped and new issue coins having the denomination to be wrapped are collected in the second coin sorting and collecting box (not shown) via the second coin sorting and collecting opening 36 and the chute (not shown). Therefore, new issue coins can be very efficiently wrapped to produce a wrapped coin roll in the operation under the wrapping mode by only depositing coins collected in the second coin sorting and collecting box into the coin depositing opening 2.

Furthermore, according to the above described embodiment, it is discriminated in the operation under the first wrapping mode whether or not coins are acceptable and past issue circulating old coins of the same denomination as that of new issue coins are discriminated unacceptable and collected in the first coin sorting and collecting box (not shown). Therefore, only new issue coins can be very efficiently wrapped to produce a wrapped coin roll by only depositing coins collected in the second coin sorting and collecting box into the coin depositing opening 2.

Moreover, according to the above described embodiment, it is discriminated in the operation under the first wrapping mode whether or not coins are acceptable and past issue circulating old coins of the same denomination as that of new issue coins are discriminated unacceptable and collected in the first coin sorting and collecting box (not shown). Therefore, even in the case where a past issue circulating old coin has not been collected in the operation under the counting mode for some reason, the past issue circulating old coin to be collected can be reliably collected in the first coin sorting and collecting box in the operation under the wrapping mode. Further, since all coins collected in the first coin sorting and collecting box in the operation under the wrapping mode are coins erroneously discriminated in the operation under the counting mode and the number thereof is very few, the operator can easily sort and collect past issue circulating old coins to be collected from among coins collected in the first coin sorting and collecting box and, therefore, past issue circulating old coins of the same denomination as that of new issue coins can be reliably sorted and efficiently collected without providing any special mechanism.

Further, according to the above described embodiment, the coin passage 5 is provided with the first straight passage 10 connected to the rotatable disk 4 at the upstream end portion thereof and extending substantially parallel to the rear surface portion 1A of the main body 1 of the coin wrapping machine, the second straight passage 11 extending substantially parallel to the side surface portion 1B of the main body 1 of the coin wrapping machine and substantially perpendicularly to the first straight passage 10, the third straight passage 12 extending substantially parallel to the front surface portion 1C of the main body 1 of the coin wrapping machine and substantially perpendicularly to the second straight passage 11, the first curved passage 13 connected to the downstream end portion of the first straight passage 10 and the upstream end portion of the second straight passage 11 for turning the coin transporting direction by substantially 90 degrees, and the second curved passage 14 connected to the downstream end portion of the second straight passage 11 and the upstream end portion of the third straight passage 12 for turning the coin transporting direction by substantially 90 degrees, thereby being disposed so as to surround the rotatable disk 4. Therefore, the coin wrapping machine can be made compact.

Figure 6:
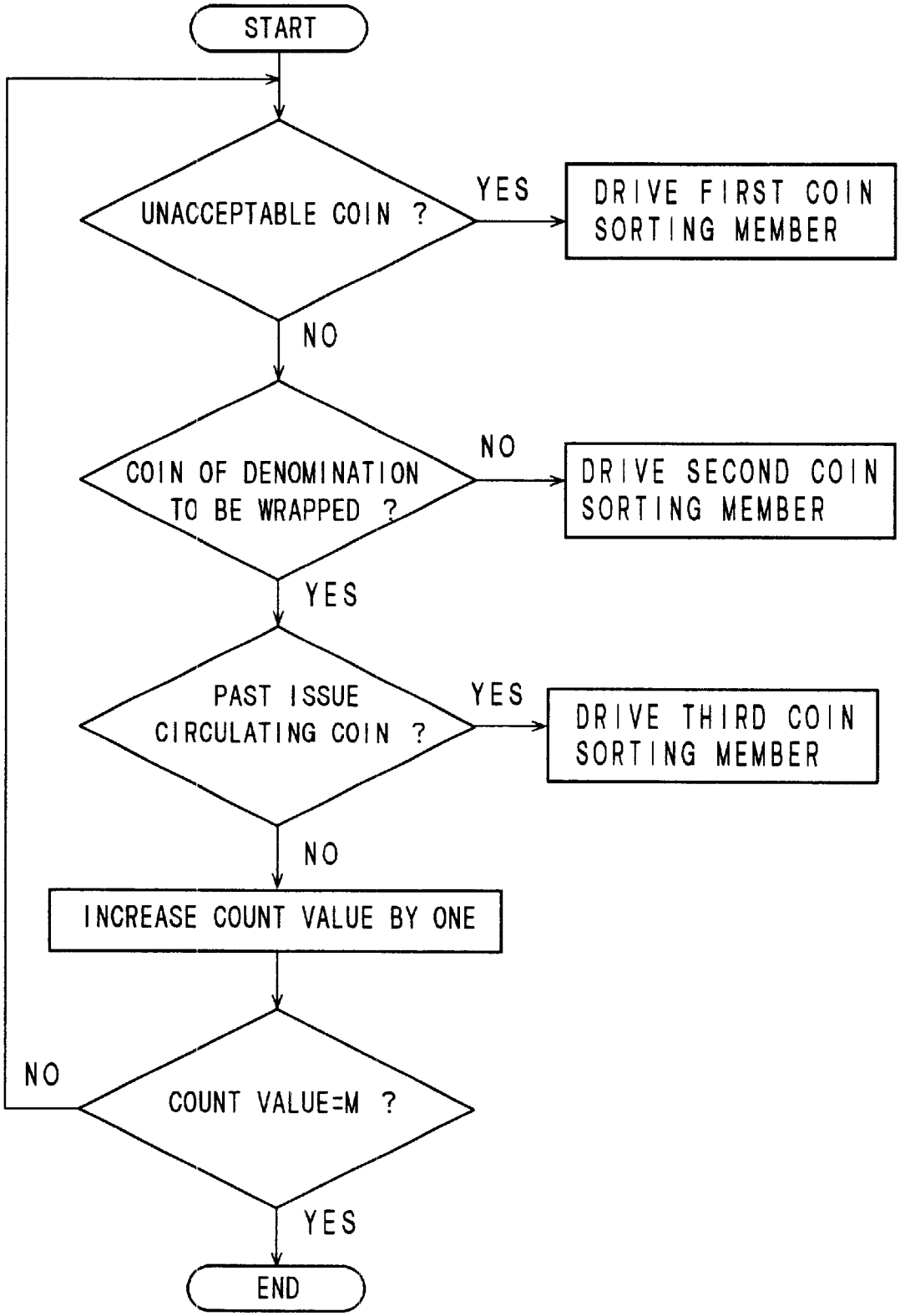
FIG. 6 is a flow chart showing an operation for again depositing coins collected in a second coin sorting and collecting box into a coin depositing opening and wrapping new issue coins to produce a wrapped coin roll when a second wrapping mode is selected.

FIG. 6 is a flow chart showing an operation for again depositing coins collected in the second coin sorting and collecting box into the coin depositing opening and wrapping new issue coins to produce a wrapped coin roll when the second wrapping mode is selected.

The denomination setting means 82 is first operated by the operator to input the denomination of new issue coins as the denomination of coins to be wrapped.

The denomination setting signal input through the denomination setting means 82 is output to the control unit 90 and the control unit 90 writes the denomination of coins to be wrapped in the RAM 92 in accordance with the denomination setting signal.

The operation mode selecting means 84 is then operated by the operator to select the wrapping mode and further select the second wrapping mode and the coin number setting means 83 is operated by the operator to set the number M of coins to be wrapped for forming a wrapped coin roll.

When a second wrapping mode selecting signal is input through the operation mode selecting means 84, the control unit 90 outputs a retracting signal to the third solenoid 75, thereby causing it to retract the third coin sorting member 47 to the retracted position thereof Further, a wrapping number setting signal is input through the coin number setting means 83 to the control unit 90 and the control unit 90 writes the number M of coins to be wrapped and specified by the wrapping number setting signal in the RAM 92 and stores it therein.

After coins collected in the second coin sorting and collecting box were again deposited by the operator into the coin depositing opening, the start button 85 is operated by the operator, thereby inputting a start signal to the control unit 90. The control unit 90 outputs drive signals to the rotatable disk motor 70 and the transporting belt motor 71, thereby rotating the rotatable disk 3 and the rotatable disk 4 and driving the first transporting belt 17 and the second transporting belt 18.

Coins again deposited into the coin depositing opening 2 by the operator are fed onto the rotatable disk 3 disposed below the coin depositing opening 2 and fed one by one onto the rotatable disk 4 by centrifugal force produced by the rotation of the rotatable disk 3.

Coins fed onto the rotatable disk 4 are fed one by one via the coin separating member (not shown) into the coin passage 5 by centrifugal force produced by the rotation of the rotatable disk 4.

When a coin fed into the coin passage 5 is detected by the pair of coin sensor $^{2}$1*a*, 21*b* provided in the first straight passage 10, a detection signal is output to the control unit 90.

When the control unit 90 receives the detection signal from the pair of coin sensor 21*a*, 21*b*, it outputs an instruction signal to the magnetic sensor 21 and causes the magnetic sensor to output magnetic properties detected thereby at the time as a magnetic data detection signal.

When the magnetic properties of the coin are detected by the magnetic sensor 21 and the magnetic data detection signal is input from the magnetic sensor 21 to the control unit 90, the control unit 90 reads reference magnetic data of each denomination of coins stored in the ROM 91 and compares them with the magnetic data of the coin detected by and input from the magnetic senor 21, thereby discriminating whether or not the coin is acceptable. When the control unit 90 determines that the coin is acceptable, it discriminates the denomination of the coin and whether or not the denomination of the coin coincides with the denomination of coins to be wrapped. When the denomination of the coin coincides with the denomination of coins to be wrapped, the control unit 90 further discriminates whether the coin is a new issue coin or a past issue circulating old coin.

Thus, the discrimination of the coin is made by the control unit 90 and the results of discrimination is written in the RAM 92.

The coin is further transported by the first transporting belt 17 in the coin passage 5 and when the pair of coin sensors 22*a*, 22*b* detects the coin fed into the second straight passage 11 from the first straight passage 10 via the first curved passage 13, a detection signal is output to the control unit 90.

When the control unit 90 receives the detection signal from the pair of coin sensors 22*a*, 22*b*, it outputs an instruction signal to the optical sensor 22, thereby causing the optical sensor 22 to output the optical properties of the coin, namely, the diameter and the surface pattern of the coin detected thereby at the time as an optical data detection signal.

When the diameter and the surface pattern of the coin are detected by the optical sensor 22 and the optical data detection signal is input from the optical sensor 22 to the control unit 90, the control unit 90 reads reference diameter data and reference surface pattern data of each denomination of coins stored in the ROM 91 and compares them with the diameter data and the surface pattern data of the coin detected by and input from the optical sensor 22, thereby discriminating whether or not the coin is acceptable. When the control unit 90 determines that the coin is acceptable, it discriminates the denomination of the coin and whether or not the denomination of the coin coincides with the denomination of coins to be wrapped. When the denomination of the coin coincides with the denomination of coins to be wrapped, the control unit 90 further discriminates whether the coin is a new issue coin or a past issue circulating old coin.

When the control unit 90 discriminates that the coin is unacceptable, it writes the results of discrimination in the RAM 92.

On the other hand, when the control unit 90 discriminates in accordance with the diameter data and the surface pattern data of the coin detected by the optical sensor 22 that the coin is an acceptable coin, it further reads the result of discrimination made based on the magnetic data detected by the magnetic sensor 21 and written in the RAM 92.

When the coin was discriminated unacceptable based on the magnetic data detected by the magnetic sensor 21, the control unit 90 finally discriminates that the coin is unacceptable irrespective of the result of discrimination made based on the diameter data and the surface pattern data of the coin detected by the optical sensor 22 and writes the result of the final discrimination in the RAM 92.

To the contrary, when the coin was discriminated acceptable based on the magnetic data detected by the magnetic sensor 21 and the denomination of the discriminated coin has been written in the RAM 92, the control unit 90 compares the result of discrimination written in the RAM 92 with the result of discrimination made based on the diameter data and the surface pattern data of the coin detected by the optical sensor 22.

When the denomination of the coin discriminated based on the diameter data and the surface pattern data of the coin detected by the optical sensor 22 does not coincide with the denomination of the coin discriminated based on the magnetic data detected by the magnetic sensor 21, the control unit 90 finally discriminates that the coin is an unacceptable coin and writes the result of final discrimination in the RAM 92.

To the contrary, when the denomination of the coin discriminated based on the diameter data and the surface pattern data of the coin detected by the optical sensor 22 coincides with the denomination of the coin discriminated based on the magnetic data detected by the magnetic sensor 21, the control unit further discriminates whether or not the denomination of the coin coincides with the denomination of coins to be wrapped.

When the denomination of the coin does not coincide with the denomination of coins to be wrapped, the control unit 90 writes the finally discriminated denomination of the coin in the RAM 92.

On the other hand, when the denomination of the coin coincides with the denomination of coins to be wrapped, the control unit 90 further discriminates whether the coin is a new issue coin or a past issue circulating old coin.

When the control unit 90 discriminates that the coin is a past issue circulating coin, it judges whether or not the result of discrimination coincides with that made based on the magnetic data detected by the magnetic sensor 21 and written in the RAM 92 and when the results of discrimination coincide with each other, it finally discriminates that the coin is a past issue circulating coin and writes the result of discrimination in the RAM 92. On the other hand, when the results of discrimination do not coincide with each other, the control unit 90 finally discriminates that the coin is unacceptable and writes the result of discrimination in the RAM 92.

To the contrary, when the control unit 90 discriminates that the coin is a new issue coin, it judges whether or not the result of discrimination coincides with that made based on the magnetic data detected by the magnetic sensor 21 and written in the RAM 92 and when the results of discrimination coincide with each other, it finally discriminates that the coin is a new issue coin. The control unit 90 then writes the result of discrimination in the RAM 92 and overwrites the count value of coins to be wrapped and stored in the RAM 92 by increasing it by one. On the other hand, when the results of discrimination do not coincide with each other, the control unit 90 finally discriminates that the coin is unacceptable and writes the result of discrimination in the RAM 92.

When the control unit 90 discriminates that the coin is unacceptable, at the time the coin sensor 33 detects the coin and a detection signal is input from the coin sensor 33, the control unit 90 outputs a drive signal to the first solenoid 73 for driving the first coin sorting member 32, thereby rotating the first coin sorting member 32 to be located at the projecting position thereof.

As a result, the unacceptable coin transported along the guide member 7 is pushed by the first coin sorting member 32 to move apart from the guide member 7 so that one edge portion of the coin is located on the first coin sorting and collecting opening 21 and is dropped into the first coin sorting and collecting opening 31, thereby being collected in the first coin sorting and collecting box (not shown) via the chute (not shown).

Therefore, unacceptable coins such as counterfeit coins and foreign coins are collected in the first coin sorting and collecting box.

To the contrary, when the control unit 90 discriminates that the coin is acceptable, it does not output a drive signal to the first solenoid 73 and, therefore, since the first coin sorting member 32 is kept at the retracted position thereof where it is retracted from the second straight passage 11, the coin passes by the first coin sorting and collecting opening 31 and is fed along the guide member 7 toward the downstream of the first coin sorting and collecting opening 31 in the second straight passage 11 .

On the other hand, when the control unit 90 discriminates that the coin is acceptable but the denomination thereof does not coincide with the denomination of coins to be wrapped, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof As a result, the coin having a different denomination from that of coins to be wrapped and transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown).

Therefore, only coins which are acceptable but have different denominations from that of coins to be wrapped are collected in the second coin sorting and collecting box.

To the contrary, in the case where the coin is a coin of the denomination to be wrapped, the control unit 90 does not output a drive signal to the second solenoid 74 and, therefore, since the second coin sorting member 37 is kept at the retracted position thereof where it is retracted from the second straight passage 11, the coin of the denomination to be wrapped passes by the second coin sorting and collecting opening 36 and is fed along the guide member 7 toward the downstream of the second coin sorting and collecting opening 36 in the second straight passage 11.

When the coin is detected by the pair of coin sensors 41*a*, 41*b* provided in the second straight passage 11 downstream of the second coin sorting and collecting opening 36, a detection signal is output to the control unit 90.

When the control unit 90 receives the detection signal from the pair of coin sensors 41*a*, 41*b*, it outputs an instruction signal to the magnetic sensor 40 and causes the magnetic sensor 40 to output the magnetic data of the coin detected thereby at the time as a magnetic data detection signal.

When the magnetic properties of the coin are detected by the magnetic sensor 40 and the magnetic data detection signal is input from the magnetic sensor 40 to the control unit 90, the control unit 90 reads reference magnetic data of new issue coins of the denomination to be wrapped and stored in the ROM 91 and compares them with the magnetic data of the coin detected by and input from the magnetic sensor 40, thereby discriminating whether or not the coin is a coin of the denomination to be wrapped.

As a result, when the control unit 90 discriminates based on the detection signal input from the magnetic sensor 40 that the coin is not a coin of the denomination to be wrapped, it judges that the coin has been erroneously discriminated and outputs drive stop signals to the rotatable disk motor 70 and the transporting belt motor 71, thereby stopping the rotation of the rotatable disk 3 and the rotatable disk 4 and the driving the first transporting belt 17 and the second transporting belt 18.

At the same time, the control unit 90 outputs an error signal to the display panel 87, thereby causing it to display a message indicating that an error has occurred and outputs an alarm signal to the alarm means 88, thereby causing it to produce an alarm.

To the contrary, when the control unit 90 discriminates based on the detection signal input from the magnetic sensor 40 that the coin is a coin of the denomination to be wrapped, it does not output any signal and, therefore, the coin passes through the magnetic sensor 40 and is fed from the second straight passage 11 to the second curved passage 14.

When the control unit 90 discriminates that the coin is a past issue circulating old coin of the denomination to be wrapped, at the time the coin sensor 50 detects the coin and a detection signal is input from the coin sensor 50, the control unit 90 outputs a drive signal to the third solenoid 75 for driving the third sorting member 47, thereby causing it to rotate the third sorting member 47 to be located at the projection position thereof As a result, the past issue circulating old coin having the denomination to be wrapped and transported along the guide member 7 is pushed by the third coin sorting member 47 to move apart from the guide member 7 so that the one edge portion thereof is located on the third coin sorting and collecting opening 46 and is dropped into the third coin sorting and collecting opening 46, thereby being collected in the coin take out box (not shown) via the cylindrical coin guide member 48 and the chute 49.

To the contrary, when the control unit 90 discriminates that the coin is a new issue coin of the denomination to be wrapped, it does not output a drive signal to the third solenoid 75 and, therefore, since the third coin sorting member 47 is kept at the retracted position where it is retracted from the second curved passage 14, the coin of the denomination to be wrapped passes by the third coin sorting and collecting opening 46 and is further fed to the third straight passage 12 and when the coin is detected by the pair of coin sensors 44*a*, 44*b* provided at the downstream end portion of the third straight passage 12, detection signals are output to the control unit 90.

When the control unit 90 receives the detection signals from the pair of coin sensors 44*a*, 44*b*, it overwrites the wrapping number count value of coins stored in the RAM 92 by increasing it by one.

Coins are further fed to the coin wrapping apparatus 60 and stacked and wrapped in the same manner as that of the first wrapping mode shown in FIG. 5.

According to this embodiment, in the wrapping operation under the second wrapping mode, unacceptable coins are collected in the first coin sorting and collecting box via the first coin sorting and collecting opening 31 and the chute and coins acceptable but having different denominations from that of coins to be wrapped are collected in the second coin sorting and collecting box via the second coin sorting and collecting opening 36 and the chute. On the other hand, past issue circulating old coins of the denomination to be wrapped are collected in the coin take-out box via the third coin sorting and collecting opening 46, the cylindrical coin guide member 48 and the chute 49 and new issue coins of the denomination to be wrapped are fed to the coin wrapping apparatus 60 and wrapped therein. Therefore, new issue coins can be wrapped, while past issue circulating old coins of the denomination to be wrapped which have been erroneously discriminated in the operation under the counting mode and have not been collected in the coin take-out box can be reliably separated from new issue coins, unacceptable coins and coins of different denominations from that of coins to be wrapped and collected.

Figure 7:
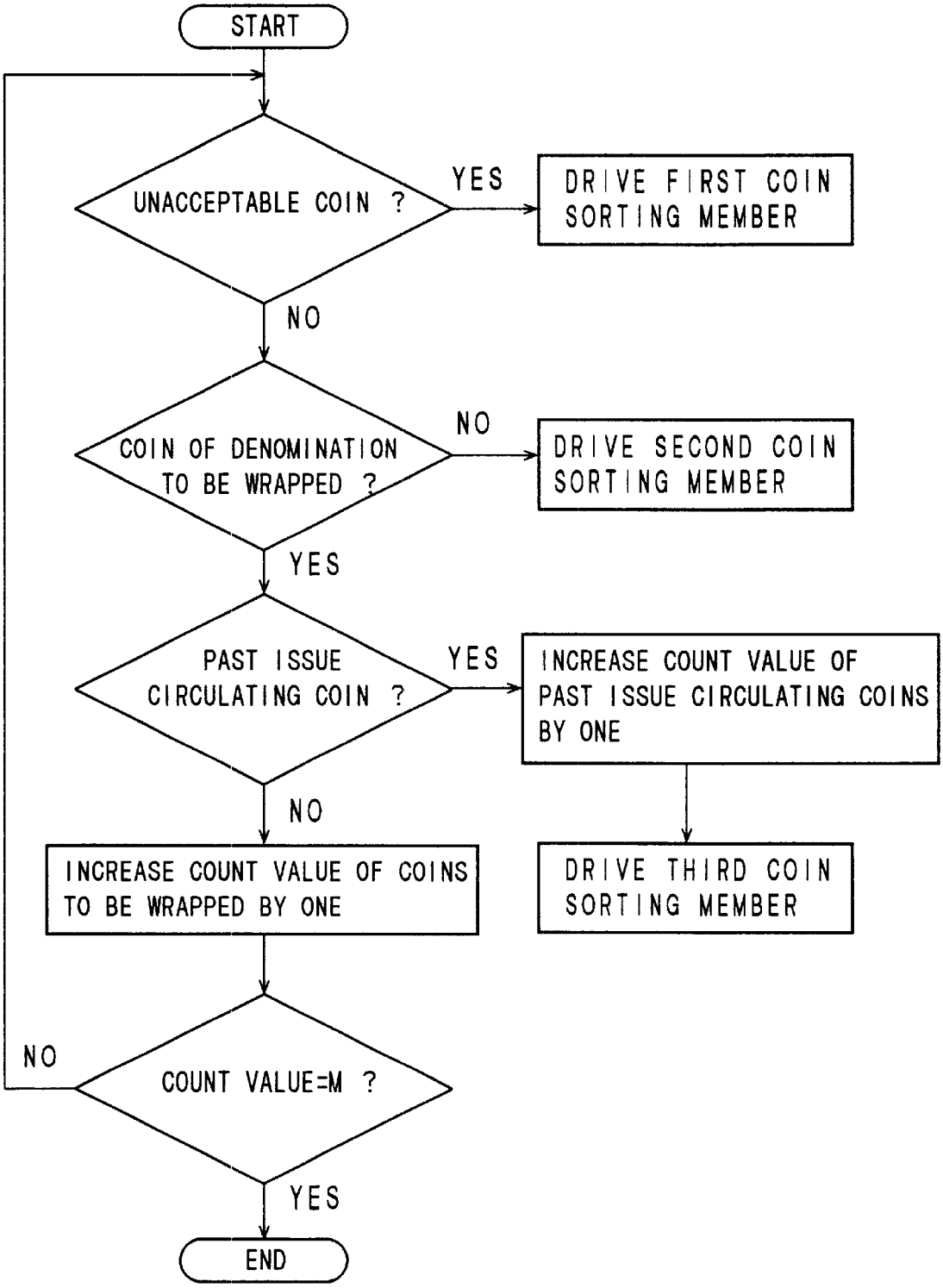
FIG. 7 is a flow chart showing an operation for wrapping new issue coins to produce a wrapped coin roll in accordance with a second wrapping mode without selecting a counting mode and sorting past issue circulating old coins from new issue coins to collect them.

FIG. 7 is a flow chart showing an operation for wrapping new issue coins to produce a wrapped coin roll in accordance with a second wrapping mode without selecting a counting mode and sorting past issue circulating old coins from new issue coins to collect them.

The denomination setting means 82 is first operated by the operator to input the denomination of new issue coins as the denomination of coins to be wrapped.

The denomination setting signal input through the denomination setting means 82 is output to the control unit 90 and the control unit 90 writes the denomination of coins to be wrapped in the RAM 92 in accordance with the denomination setting signal.

The operation mode selecting means 84 is then operated by the operator to select the wrapping mode and further select the second wrapping mode and the coin number setting means 83 is operated by the operator to set the number M of coins to be wrapped for forming a wrapped coin roll.

When a second wrapping mode selecting signal is input through the operation mode selecting means 84, the control unit 90 outputs a retracting signal to the third solenoid 75, thereby causing it to retract the third coin sorting member 47 to the retracted position thereof.

Further, a wrapping number setting signal is input through the coin number setting means 83 to the control unit 90 and the control unit 90 writes the number M of coins to be wrapped and specified by the wrapping number setting signal in the RAM 92 and stores it therein.

After coins were deposited by the operator into the coin depositing opening, the start button 85 is operated by the operator, thereby inputting a start signal to the control unit 90. The control unit 90 outputs drive signals to the rotatable disk motor 70 and the transporting belt motor 71, thereby rotating the rotatable disk 3 and the rotatable disk 4 and driving the first transporting belt 17 and the second transporting belt 18.

Coins deposited into the coin depositing opening 2 by the operator are fed onto the rotatable disk 3 disposed below the coin depositing opening 2 and fed one by one onto the rotatable disk 4 by centrifugal force produced by the rotation of the rotatable disk 3.

Coins fed onto the rotatable disk 4 are fed one by one via the coin separating member (not shown) into the coin passage 5 by centrifugal force produced by the rotation of the rotatable disk 4.

When a coin fed into the coin passage 5 is detected by the pair of coin sensor 21*a*, 21*b* provided in the first straight passage 10, a detection signal is output to the control unit 90.

When the control unit 90 receives the detection signal from the pair of coin sensor 21*a*, 21*b*, it outputs an instruction signal to the magnetic sensor 21 and causes the magnetic sensor to output magnetic properties detected thereby at the time as a magnetic data detection signal.

When the magnetic properties of the coin are detected by the magnetic sensor 21 and the magnetic data detection signal is input from the magnetic sensor 21 to the control unit 90, the control unit 90 reads reference magnetic data of each denomination of coins stored in the ROM 91 and compares them with the magnetic data of the coin detected by and input from the magnetic sensor 21, thereby discriminating whether or not the coin is acceptable. When the control unit 90 determines that the coin is acceptable, it discriminates the denomination of the coin and whether or not the denomination of the coin coincides with the denomination of coins to be wrapped. When the denomination of the coin coincides with the denomination of coins to be wrapped, the control unit 90 further discriminates whether the coin is a new issue coin or a past issue circulating old coin.

Thus, the discrimination of the coin is made by the control unit 90 and the results of discrimination is written in the RAM 92.

The coin is further transported by the first transporting belt 17 in the coin passage 5 and when the pair of coin sensors 22*a*, 22*b* detects the coin fed into the second straight passage 11 from the first straight passage 10 via the first curved passage 13, a detection signal is output to the control unit 90.

When the control unit 90 receives the detection signal from the pair of coin sensors 22*a*, 22*b*, it outputs an instruction signal to the optical sensor 22, thereby causing the optical sensor 22 to output the optical properties of the coin, namely, the diameter and the surface pattern of the coin detected thereby at the time as an optical data detection signal.

When the diameter and the surface pattern of the coin are detected by the optical sensor 22 and the optical data detection signal is input from the optical sensor 22 to the control unit 90, the control unit 90 reads reference diameter data and reference surface pattern data of each denomination of coins stored in the ROM 91 and compares them with the diameter data and the surface pattern data of the coin detected by and input from the optical sensor 22, thereby discriminating whether or not the coin is acceptable. When the control unit 90 determines that the coin is acceptable, it discriminates the denomination of the coin and whether or not the denomination of the coin coincides with the denomination of coins to be wrapped. When the denomination of the coin coincides with the denomination of coins to be wrapped, the control unit 90 further discriminates whether the coin is a new issue coin or a past issue circulating old coin.

When the control unit 90 discriminates that the coin is unacceptable, it writes the results of discrimination in the RAM 92.

On the other hand, when the control unit 90 discriminates in accordance with the diameter data and the surface pattern data of the coin detected by the optical sensor 22 that the coin is an acceptable coin, it further reads the result of discrimination made based on the magnetic data detected by the magnetic sensor 21 and written in the RAM 92.

As a result, when the coin was discriminated unacceptable based on the magnetic data detected by the magnetic sensor 21, the control unit 90 finally discriminates that the coin is unacceptable irrespective of the result of discrimination made based on the diameter data and the surface pattern data of the coin detected by the optical sensor 22 and writes the result of the final discrimination in the RAM 92.

To the contrary, when the coin was discriminated acceptable based on the magnetic data detected by the magnetic sensor 21 and the denomination of the discriminated coin has- been written in the RAM 92, the control unit 90 compares the result of discrimination written in the RAM 92 with the result of discrimination made based on the diameter data and the surface pattern data of the coin detected by the optical sensor 22.

When the denomination of the coin discriminated based on the diameter data and the surface pattern data of the coin detected by the optical sensor 22 does not coincide with the denomination of the coin discriminated based on the magnetic data detected by the magnetic sensor 21, the control unit 90 finally discriminates that the coin is an unacceptable coin and writes the result of final discrimination in the RAM 92.

To the contrary, when the denomination of the coin discriminated based on the diameter data and the surface pattern data of the coin detected by the optical sensor 22 coincides with the denomination of the coin discriminated based on the magnetic data detected by the magnetic sensor 21, the control unit further discriminates whether or not the denomination of the coin coincides with the denomination of coins to be wrapped.

When the denomination of the coin does not coincide with the denomination of coins to be wrapped, the control unit 90 writes the finally discriminated denomination of the coin in the RAM 92.

On the other hand, when the denomination of the coin coincides with the denomination of coins to be wrapped, the control unit 90 further discriminates whether the coin is a new issue coin or a past issue circulating old coin.

When the control unit 90 discriminates that the coin is a past issue circulating coin, it judges whether or not the result of discrimination coincides with that made based on the magnetic data detected by the magnetic sensor 21 and written in the RAM 92 and when the results of discrimination coincide with each other, it finally discriminates that the coin is a past issue circulating coin and writes the result of discrimination in the RAM 92. On the other hand, when the results of discrimination do not coincide with each other, the control unit 90 finally discriminates that the coin is unacceptable and writes the result of discrimination in the RAM 92.

To the contrary, when the control unit 90 discriminates that the coin is a new issue coin, it judges whether or not the result of discrimination coincides with that made based on the magnetic data detected by the magnetic sensor 21 and written in the RAM 92 and when the results of discrimination coincide with each other, it finally discriminates that the coin is a new issue coin. The control unit 90 then writes the result of discrimination in the RAM 92 and overwrites the count value of coins to be wrapped and stored in the RAM 92 by increasing it by one. On the other hand, when the results of discrimination do not coincide with each other, the control unit 90 finally discriminates that the coin is unacceptable and writes the result of discrimination in the RAM 92.

When the control unit 90 discriminates that the coin is unacceptable, at the time the coin sensor 33 detects the coin and a detection signal is input from the coin sensor 33, the control unit 90 outputs a drive signal to the first solenoid 73 for driving the first coin sorting member 32, thereby rotating the first coin sorting member 32 to be located at the projecting position thereof.

As a result, the unacceptable coin transported along the guide member 7 is pushed by the first coin sorting member 32 to move apart from the guide member 7 so that one edge portion of the coin is located on the first coin sorting and collecting opening 31 and is dropped into the first coin sorting and collecting opening 31, thereby being collected in the first coin sorting and collecting box (not shown) via the chute (not shown).

Therefore, unacceptable coins such as counterfeit coins and foreign coins are collected in the first coin sorting and collecting box.

To the contrary, when the control unit 90 discriminates that the coin is acceptable, it does not output a drive signal to the first solenoid 73 and, therefore, since the first coin sorting member 32 is kept at the retracted position thereof where it is retracted from the second straight passage 11, the coin passes by the first coin sorting and collecting opening 31 and is fed along the guide member 7 toward the downstream of the first coin sorting and collecting opening 31 in the second straight passage 11.

On the other hand, when the control unit 90 discriminates that the coin is acceptable but the denomination thereof does not coincide with the denomination of coins to be wrapped, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof.

As a result, the coin having a different denomination from that of coins to be wrapped and transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown).

Therefore, only coins which are acceptable but have different denominations from that of coins to be wrapped are collected in the second coin sorting and collecting box.

To the contrary, in the case where the coin is a coin of the denomination to be wrapped, the control unit 90 does not output a drive signal to the second solenoid 74 and, therefore, since the second coin sorting member 37 is kept at the retracted position thereof where it is retracted from the second straight passage 11, the coin of the denomination to be wrapped passes by the second coin sorting and collecting opening 36 and is fed along the guide member 7 toward the downstream of the second coin sorting and collecting opening 36 in the second straight passage 11.

When the coin is detected by the pair of coin sensors 41*a*, 41*b* provided in the second straight passage 11 downstream of the second coin sorting and collecting opening 36, a detection signal is output to the control unit 90.

When the control unit 90 receives the detection signal from the pair of coin sensors 41*a*, 41*b*, it outputs an instruction signal to the magnetic sensor 40 and causes the magnetic sensor 40 to output the magnetic data of the coin detected thereby at the time as a magnetic data detection signal.

When the magnetic properties of the coin are detected by the magnetic sensor 40 and the magnetic data detection signal is input from the magnetic sensor 40 to the control unit 90, the control unit 90 reads reference magnetic data of new issue coins of the denomination to be wrapped and stored in the ROM 91 and compares them with the magnetic data of the coin detected by and input from the magnetic sensor 40, thereby discriminating whether or not the coin is a coin of the denomination to be wrapped.

When the control unit 90 discriminates based on the detection signal input from the magnetic sensor 40 that the coin is not a coin of the denomination to be wrapped, it judges that the coin has been erroneously discriminated and outputs drive stop signals to the rotatable disk motor 70 and the transporting belt motor 71, thereby stopping the rotation of the rotatable disk 3 and the rotatable disk 4 and the driving the first transporting belt 17 and the second transporting belt 18.

At the same time, the control unit 90 outputs an error signal to the display panel 87, thereby causing it to display a message indicating that an error has occurred and outputs an alarm signal to the alarm means 88, thereby causing it to produce an alarm.

To the contrary, when the control unit 90 discriminates based on the detection signal input from the magnetic sensor 40 that the coin is a coin of the denomination to be wrapped, it does not output any signal and, therefore, the coin passes by the magnetic sensor 40 and is fed from the second straight passage 11 to the second curved passage 14.

When the control unit 90 discriminates that the coin is a past issue circulating old coin of the denomination to be wrapped, at the time the coin sensor 50 detects the coin and a detection signal is input from the coin sensor 50, the control unit 90 outputs a drive signal to the third solenoid 75 for driving the third sorting member 47, thereby causing it to rotate the third sorting member 47 to be located at the projection position thereof As a result, the past issue circulating old coin having the denomination to be wrapped and transported along the guide member 7 is pushed by the third coin sorting member 47 to move apart from the guide member 7 so that the one edge portion thereof is located on the third coin sorting and collecting opening 46 and is dropped into the third coin sorting and collecting opening 46, thereby being collected in the coin take-out box (not shown) via the cylindrical coin guide member 48 and the chute 49.

At the same time, the control unit 90 overwrites the counting number of the past issue circulating old coins stored in the RAM 92 by increasing it by one.

To the contrary, when the control unit 90 discriminates that the coin is a new issue coin of the denomination to be wrapped, it does not output a drive signal to the third solenoid 75 and, therefore, since the third coin sorting member 47 is kept at the retracted position where it is retracted from the second curved passage 14, the coin of the denomination to be wrapped passes by the third coin sorting and collecting opening 46 and is further fed to the third straight passage 12 and when a coin is detected by the pair of coin sensors 44*a*, 44*b* provided at the downstream end portion of the third straight passage 12, detection signals are output to the control unit 90.

When the control unit 90 receives the detection signals from the pair of coin sensors 44*a*, 44*b*, it overwrites the wrapping number count value of coins stored in the RAM 92 by increasing it by one.

Coins are further fed to the coin wrapping apparatus 60 and stacked and wrapped in the same manner as that of the first wrapping mode shown in FIG. 5.

According to this embodiment, although past issue circulating old coins have not been separated and collected from new issue coins since the counting operation is not performed, unacceptable coins are collected in the first coin sorting and collecting box via the first coin sorting and collecting opening 31 and the chute and acceptable coins having different denominations from that of coins to be wrapped are collected in the second coin sorting and collecting box via the second coin sorting and collecting opening 36 and the chute. On the other hand, past issue circulating old coins of the denomination to be wrapped are collected in the coin take-out box via the third coin sorting and collecting opening 46, the cylindrical coin guide member 48 and the chute 49 and new issue coins are fed to the coin wrapping apparatus 60 and wrapped therein. Therefore, it is possible to extremely efficiently separate and collect past issue circulating old coins from new issue coins and wrap new issue coins to produce a wrapped coin roll by setting the operation mode to be the second wrapping mode and performing the wrapping operation of new issue coins without setting the operation mode to be the counting mode and separating and collecting past issue circulating old coins from new issue coins.

Further, according to this embodiment, past issue circulating old coins to wrapped are separated from new issue coins and collected in the coin take-out box, while being counted. Therefore, not only new issue coins can be wrapped to produce a wrapped coin roll but also past issue circulating old coins to wrapped can be separated from new issue coins and collected in the coin take-out box, while being counted.

Figure 8:
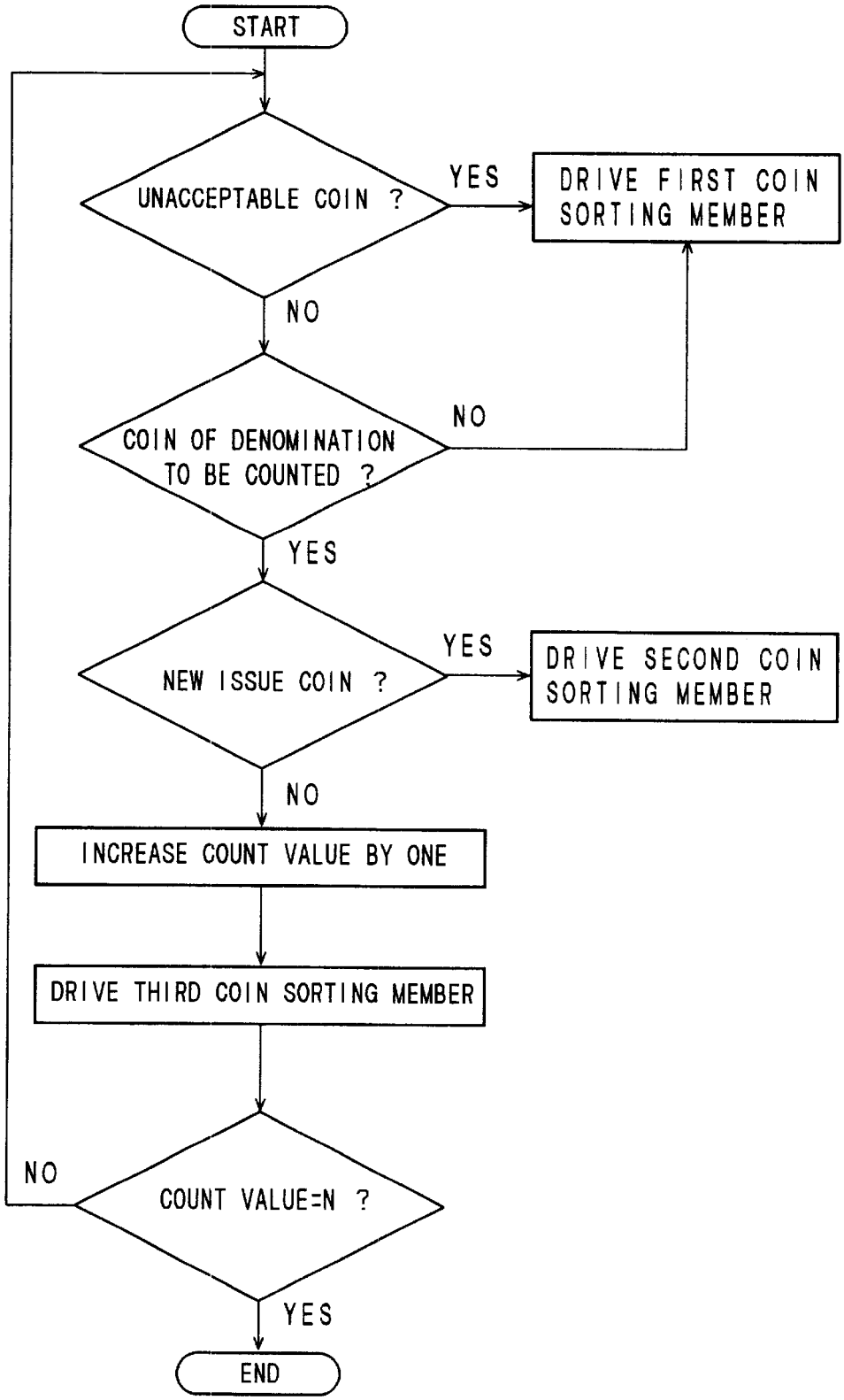
FIG. 8 is a flow chart showing a counting operation for collecting past issue circulating old coins of the same denomination as that of new issue coins under a counting mode of a coin wrapping machine which is a further embodiment of the present invention.

FIG. 8 is a flow chart showing a counting operation for collecting past issue circulating old coins of the same denomination as that of new issue coins under a counting mode of a coin wrapping machine which is a further embodiment of the present invention.

In this embodiment, when the counting mode is selected, the coin wrapping machine collects unacceptable coins and coins of different denominations from that of coins to be counted in the first coin sorting and collecting box via the first coin sorting and collecting opening 31 and the chute, collects new issue coins of the denomination to be counted in the second coin sorting and collecting box via the second coin sorting and collecting opening 36 and the chute and leads past issue circulating old coins of the same denomination as that of new issue coins into the coin take-out box via the third coin sorting and collecting opening 46, the cylindrical coin guide member 48 and the chute 49, thereby being collected therein.

Specifically, the denomination setting means 82 is first operated by the operator to input the denomination of past issue circulating coins of the same denomination as that of new issue coins as the denomination of coins to be counted.

The denomination setting signal input through the denomination setting means 82 is output to the control unit 90 and the control unit 90 writes the denomination of coins to be counted in the RAM 92 in accordance with the denomination setting signal.

The operation mode selecting means 84 is then operated by the operator to select a counting mode and the coin number setting means 83 is operated by the operator to set a unit count number N of the past issue circulating old coins and to be counted by one counting operation.

When a counting mode selecting signal is input through the operation mode selecting means 84, the control unit 90 outputs a projection signal to the third solenoid 75, thereby causing it to locate the third coin sorting member 47 at the projecting position where the third coin sorting member 47 projects into the second curved passage 14.

A unit count number setting signal is input through the coin number setting means 83 to the control unit 90 and the control unit 90 writes the unit count number N specified by the unit count number setting signal in the RAM 92, thereby storing it therein.

When the start button 85 is operated by the operator, a start signal is input to the control unit 90. The control unit 90 outputs drive signals to the rotatable disk motor 70 and the transporting belt motor 71, thereby rotating the rotatable disk 3 and the rotatable disk 4 and driving the first transporting belt 17 and the second transporting belt 18.

Coins deposited into the coin depositing opening 2 by the operator are fed onto the rotatable disk 3 disposed below the coin depositing opening 2 and fed one by one onto the rotatable disk 4 by centrifugal force produced by the rotation of the rotatable disk 3.

Coins fed onto the rotatable disk 4 are fed one by one via the coin separating member (not shown) into the coin passage 5 by centrifugal force produced by the rotation of the rotatable disk 4.

When a coin fed into the coin passage 5 is detected by the pair of coin sensor 21*a*, 21*b* provided in the first straight passage 10, a detection signal is output to the control unit 90.

When the control unit 90 receives the detection signal from the pair of coin sensor 21*a*, 21*b*, it outputs an instruction signal to the magnetic sensor 21 and causes the magnetic sensor to output magnetic properties detected thereby at the time as a magnetic data detection signal.

When the magnetic properties of the coin are detected by the magnetic sensor 21 and the magnetic data detection signal is input from the magnetic sensor 21 to the control unit 90, the control unit 90 reads reference magnetic data of each denomination of coins stored in the ROM 91 and compares them with the magnetic data of the coin detected by and input from the magnetic sensor 21, thereby discriminating whether or not the coin is acceptable. When the control unit 90 determines that the coin is acceptable, it discriminates the denomination of the coin and whether or not the denomination of the coin coincides with the denomination of coins to be counted. As a result, when the denomination of the coin coincides with the denomination of coins to be counted, the control unit 90 further discriminates whether the coin is a new issue coin or a past issue circulating old coin and writes the results of discrimination in the RAM 92.

The coin is further transported by the first transporting belt 17 in the coin passage 5 and when the pair of coin sensors 22*a*, 22*b* detects the coin fed into the second straight passage 11 from the first straight passage 10 via the first curved passage 13, a detection signal is output to the control unit 90.

When the control unit 90 receives the detection signal from the pair of coin sensors 22*a*, 22*b*, it outputs an instruction signal to the optical sensor 22, thereby causing the optical sensor 22 to output the optical properties of the coin, namely, the diameter and the surface pattern of the coin detected thereby at the time as an optical data detection signal.

When the diameter and the surface pattern of the coin are detected by the optical sensor 22 and the optical data detection signal input from the optical sensor 22 to the control unit 90, the control unit 90 reads reference diameter data and reference surface pattern data of each denomination of coins stored in the ROM 91 and compares them with the diameter data and the surface pattern data of the coin detected by and input from the optical sensor 22, thereby discriminating whether or not the coin is acceptable. When the control unit 90 determines that the coin is acceptable, it discriminates the denomination of the coin and whether or not the denomination of the coin coincides with the denomination of coins to be counted. When the denomination of the coin coincides with the denomination of coins to be counted, the control unit 90 further discriminates whether the coin is a new issue coin or a past issue circulating old coin.

When the control unit 90 discriminates that the coin is unacceptable, it writes the results of discrimination in the RAM 92.

On the other hand, when the control unit 90 discriminates in accordance with the diameter data and the surface pattern data of the coin detected by the optical sensor 22 that the coin is an acceptable coin, it further reads the result of discrimination made based on the magnetic data detected by the magnetic sensor 21 and written in the RAM 92.

When the coin was discriminated unacceptable based on the magnetic data detected by the magnetic sensor 21, the control unit 90 finally discriminates that the coin is unacceptable irrespective of the result of discrimination made based on the diameter data and the surface pattern data of the coin detected by the optical sensor 22 and writes the result of the final discrimination in the RAM 92.

To the contrary, when the coin was discriminated acceptable based on the magnetic data detected by the magnetic sensor 21 and the denomination of the discriminated coin has been written in the RAM 92, the control unit 90 compares the result of discrimination written in the RAM 92 with the result of discrimination made based on the diameter data and the surface pattern data of the coin detected by the optical sensor 22.

When the denomination of the coin discriminated based on the diameter data and the surface pattern data of the coin detected by the optical sensor 22 does not coincide with the denomination of the coin discriminated based on the magnetic data detected by the magnetic sensor 21, the control unit 90 finally discriminates that the coin is an unacceptable coin and writes the result of final discrimination in the RAM 92.

To the contrary, when the denomination of the coin discriminated based on the diameter data and the surface pattern data of the coin detected by the optical sensor 22 coincides with the denomination of the coin discriminated based on the magnetic data detected by the magnetic sensor 21, the control unit further discriminates whether or not the denomination of the coin coincides with the denomination of coins to be counted.

When the denomination of the coin does not coincide with the denomination of coins to be counted, the control unit 90 writes the finally discriminated denomination of the coin in the RAM 92.

On the other hand, when the denomination of the coin coincides with the denomination of coins to be counted, the control unit 90 further discriminates whether the coin is a new issue coin or a past issue circulating old coin and compares the result of discrimination with the result of discrimination made based on the magnetic data detected by the magnetic sensor 21 and written in the RAM 92.

When the result of discrimination made based on the magnetic data detected by the magnetic sensor 21 and written in the RAM 92 does not coincide with the result of discrimination made based on the optical data detected by the optical sensor 22, the control unit 90 finally discriminates that the coin is an unacceptable coin and writes the result of final discrimination in the RAM 92.

To the contrary, when the result of discrimination made based on the magnetic data detected by the magnetic sensor 21 and written in the RAM 92 coincides with the result of discrimination made based on the optical data detected by the optical sensor 22, the control unit 90 writes the result of final discrimination as to whether the coin is a new issue coin or a past issue circulating old coin in the RAM 92 and when the control unit 90 discriminates that the coin is a past issue circulating old coin, it overwrites the count value of coins stored in the RAM 92 by increasing it by one.

An unacceptable coin or an acceptable coin of different denomination from that of coins to be counted is fed in the second straight passage 11 and when the coin sensor 33 detects the coin and a detection signal is input from the coin sensor 33 to the control unit 90, the control unit 90 outputs a drive signal to the first solenoid 73 for driving the first coin sorting member 32, thereby rotating the first coin sorting member 32 to be located at the projecting position thereof.

As a result, the unacceptable coin or the acceptable coin of different denomination from that of coins to be counted transported along the guide member 7 is pushed by the first coin sorting member 32 to move apart from the guide member 7 so that one edge portion of the coin is located on the first coin sorting and collecting opening 31 and is dropped into the first coin sorting and collecting opening 31, thereby being collected in the first coin sorting and collecting box (not shown) via the chute (not shown).

To the contrary, when the control unit 90 discriminates that the denomination of the coin coincides with the denomination of coins to be counted, it does not output a drive signal to the first solenoid 73 and, therefore, since the first coin sorting member 32 is kept at the retracted position thereof where It is retracted from the second straight passage 11, the coin passes by the first coin sorting and collecting opening 31 and is fed along the guide member 7 toward the downstream of the first coin sorting and collecting opening 31 in the second straight passage 11.

On the other hand, when the control unit 90 discriminates that the denomination of the coin coincides with the denomination of coins to be counted but the coin is a new issue coin, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof As a result, the coin transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown).

In this manner, all new issue coins of the denomination to be counted are dropped into the second coin sorting and collecting opening 36 and collected in the second coin sorting and collecting box (not shown) via the chute (not shown).

To the contrary, in the case where the coin is a past issue circulating old coin of the denomination to be counted, the control unit 90 does not output a drive signal to the second solenoid 74 and, therefore, since the second coin sorting member 37 is kept at the retracted position thereof where it is retracted from the second straight passage 11, the past issue circulating old coin of the denomination to be counted passes by the second coin sorting and collecting opening 36 and is fed along the guide member 7 toward the downstream of the second coin sorting and collecting opening 36 in the second straight passage 11.

When the coin is detected by the pair of coin sensors 41*a*, 41*b* provided in the second straight passage 11 downstream of the second coin sorting and collecting opening 36, a detection signal is output to the control unit 90.

When the control unit 90 receives the detection signal from the pair of coin sensors 41*a*, 41*b*, it outputs an instruction signal to the magnetic sensor 40 and causes the magnetic sensor 40 to output the magnetic data of the coin detected thereby at the time as a magnetic data detection signal.

When the magnetic properties of the coin are detected by the magnetic sensor 40 and the magnetic data detection signal is input from the magnetic sensor 40 to the control unit 90, the control unit 90 reads reference magnetic data of past issue circulating old coins of the denomination to be counted and stored in the ROM 91 and compares them with the magnetic data of the coin detected by and input from the magnetic sensor 40, thereby discriminating whether or not the coin is a past issue circulating old coin of the denomination to be counted.

When the control unit 90 discriminates based on the detection signal input from the magnetic sensor 40 that the coin is not a past issue circulating old coin of the denomination to be counted, it judges that the coin has been erroneously discriminated and outputs drive stop signals to the rotatable disk motor 70 and the transporting belt motor 71, thereby stopping the rotation of the rotatable disk 3 and the rotatable disk 4 and the driving the first transporting belt 17 and the second transporting belt 18.

At the same time, the control unit 90 outputs an error signal to the display panel 87, thereby causing it to display a message indicating that an error has occurred and outputs an alarm signal to the alarm means 88, thereby causing it to produce an alarm.

To the contrary, when the control unit 90 discriminates based on the detection signal input from the magnetic sensor 40 that the coin is a past issue circulating old coin of the denomination to be counted, it does not output any signal and, therefore, the coin passes through the magnetic sensor 40 and is fed from the second straight passage 11 to the second curved passage 14.

In this embodiment, in the case where a counting mode is selected, since the third coin sorting member 47 is located at the projecting position where it projects in the second curved passage 14, every past issue circulating old coin of the same denomination as that of new issue coins is pushed by the third coin sorting member 47 so that the one edge portion thereof is located on the third coin sorting and collecting opening 46 and the coin is dropped into the third coin sorting and collecting opening 46, thereby being collected in the coin take-out box (not shown) via the cylindrical coin guide member 48 and the chute 49.

In this manner, when the control unit 90 judges that the count value of past issue circulating old coins of the denomination stored in the RAM 92 has become equal to the unit count number N by which coins are to be counted in one counting operation and which is set through the coin number setting means 83 and stored in the RAM 92, the control unit 90 outputs a drive signal at a predetermined time to the stopper solenoid 72 for driving the pair of stopper members 26*a*, 26*b*, thereby causing it to rotate the pair of stopper members 26*a*, 26*b* to be located the projecting position thereof As a result, the coin following the Nth past issue circulating old coin of the denomination to be counted detected by the optical sensor 22 is stopped by the pair of stopper members 26*a*, 26*b* to be prevented from being transported.

When the magnetic sensor detects the Nth past issue circulating old coin of the denomination to be counted and a detection signal is input to the control unit 90, the control unit 90 outputs reverse drive signals to the rotatable disk motor 70 and the transporting belt motor 71, thereby rotating the rotatable disk 3 and the rotatable disk 4 in the reverse direction and driving the first transporting belt 17 and the second transporting belt 18 in the reverse direction so as to return a coin fed into the coin passage 5 from the rotatable disk 4 and following the Nth old coin back onto the rotatable disk 4.

When a predetermined time period has passed after the magnetic sensor 21 provided in the first straight passage 10 detected the last coin, the control unit 90 terminates one cycle of the counting operation of coins.

When it is judged based on the detection signals from the magnetic sensor 21 and the optical sensor 22 that coins which have not been counted remain on the rotatable disk 4, the operator again operates the start button 85 to cause the coin wrapping machine to conduct the next cycle of the counting operation of coins.

When after repeating counting cycles of coins in this manner, a predetermined time period passes after the optical sensor 22 detected the last coin during the counting operation of coins of a certain denomination, even though the pair of stopper members 26*a*, 26*b* were not driven, the control unit 90 judges that all coins deposited into the coin depositing opening 2 have been fed into the coin passage 5 and detected by the optical sensor 22 before the count value of past issue circulating old coins of the same denomination as that of coins to be counted, which is stored in the RAM 92, became equal to the predetermined number N and immediately terminates the counting operation of coins.

As a result, all past issue circulating old coins to be counted are led via the third coin sorting and collecting opening 46, the cylindrical coin guide member 48 and the chute 49 to the coin take-out box (not shown) and collected. On the other hand, new issue coins of the denomination to be counted are collected in the second coin sorting and collecting box (not shown) via the second coin sorting and collecting opening 36 and the chute (not shown). Therefore, past issue circulating old coins can be collected separately from new issue coins.

According to this embodiment, new issue coins are collected in the second sorting and collecting box and past issue circulating coins of the same denomination as that of new issue coins are led into and collected in the coin take-out box via the third coin sorting and collecting opening 46, the cylindrical coin guide member 48 and the chute 49, so that new issue coins and past issue circulating coins of the same denomination as that of new issue coins can be reliably collected separately from each other in one counting operation.

Further, according to this embodiment, although acceptable coins of different denominations from that of coins to be counted are collected in the first sorting and collecting box together with unacceptable coins, the number of unacceptable coins is few and unacceptable coins can be easily separated and collected during a counting operation or wrapping operation of acceptable coins of different denominations from that of coins to be counted. Therefore, new issue coins and past issue circulating coins of the same denomination as that of new issue coins can be reliably and effectively collected separately from each other in one counting operation.

Figure 9:
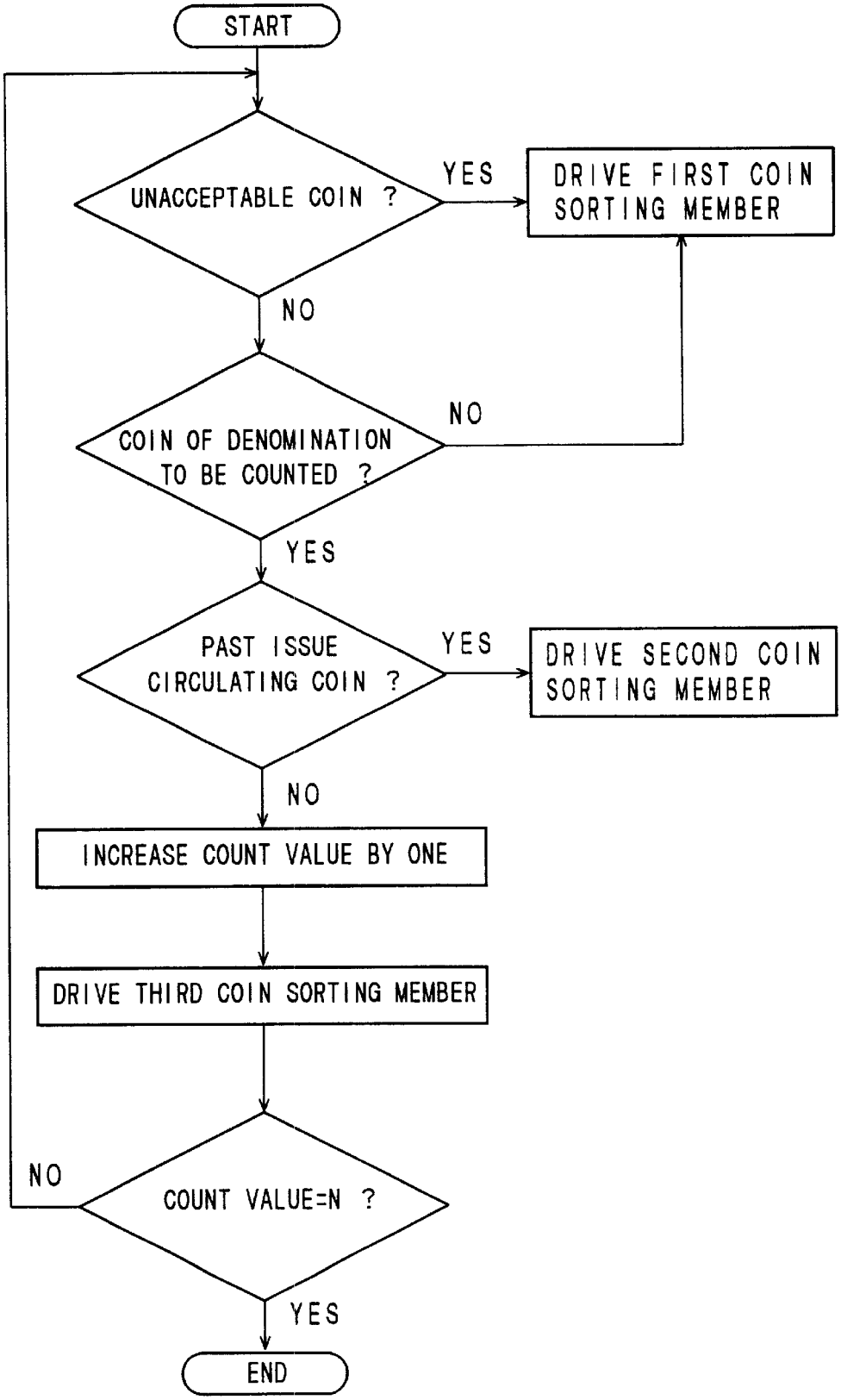
FIG. 9 is a flow chart showing a counting operation for collecting past issue circulating old coins of the same denomination as that of new issue coins under a counting mode of a coin wrapping machine which is a further embodiment of the present invention.

FIG. 9 is a flow chart showing a counting operation for collecting past issue circulating old coins of the same denomination as that of new issue coins under a counting mode of a coin wrapping machine which is a further embodiment of the present invention.

In this embodiment, new issue coins and past issue circulating coins of the same denomination as that of the new issue coins are collected separately from each other in the same manner as in the embodiment shown in FIG. 8 except that when the counting mode is selected, the coin wrapping machine is constituted to collect unacceptable coins and coins of different denominations from that of coins to be counted in the first coin sorting and collecting box via the first coin sorting and collecting opening 31 and the chute, collect past issue circulating old coins of the same denomination as that of new issue coins to be counted in the second coin sorting and collecting box via the second coin sorting and collecting opening 36 and the chute and lead new issue coins of the denomination to be counted into the coin take-out box via the third coin sorting and collecting opening 46, the cylindrical coin guide member 48 and the chute 49 to be collected therein.

Specifically, in this embodiment, when the control unit 90 discriminates that the denomination of a coin coincides with that of coins to be counted but the coin is a past issue circulating coin, at the time the coin sensor 38 detects the coin and a detection signal is input from the coin sensor 38, the control unit 90 outputs a drive signal to the second solenoid 74 for driving the second coin sorting member 37, thereby rotating the second coin sorting member 37 to be located at the projecting position thereof.

As a result, the old coin transported along the guide member 7 is pushed by the second coin sorting member 37 to move apart from the guide member 7 so that one edge portion of the coin is located on the second coin sorting and collecting opening 36 and is dropped into the second coin sorting and collecting opening 36, thereby being collected in the second coin sorting and collecting box (not shown) via the chute (not shown). Therefore, all past issue circulating coins of the denomination to be counted are dropped into the second coin sorting and collecting opening 36 and collected in the second coin sorting and collecting box via the chute (not shown).

To the contrary, in the case where the coin is a new issue coin of the denomination to be counted, the control unit 90 does not output a drive signal to the second solenoid 74 and, therefore, since the second coin sorting member 37 is kept at the retracted position thereof where it is retracted from the second straight passage 11, the new issue coin of the denomination to be counted passes by the second coin sorting and collecting opening 36 and is fed along the guide member 7 toward the downstream of the second coin sorting and collecting opening 36 in the second straight passage 11.

In this manner, new issue coins of the denomination to be counted are fed into the second curved passage 14.

In the case where a counting mode is selected, since the third coin sorting member 47 is located at the projecting position where it projects in the second curved passage 14, every new issue coin is pushed by the third coin sorting member 47 so that the one edge portion thereof is located on the third coin sorting and collecting opening 46 and the coin is dropped into the third coin sorting and collecting opening 46, thereby being collected in the coin take-out box (not shown) via the cylindrical coin guide member 48 and the chute 49.

According to this embodiment, since all new issue coins are led into the coin take-out box via the third coin sorting and collecting opening 46, the cylindrical coin guide member 48 and the chute 49 to be collected therein and all past issue circulating coins of the same denomination as that of the new issue coins are collected in the second coin sorting and collecting box, new issue coins and past issue circulating coins of the same denomination as that of new issue coins can be reliably collected separately from each other in one counting operation.

Figure 10:
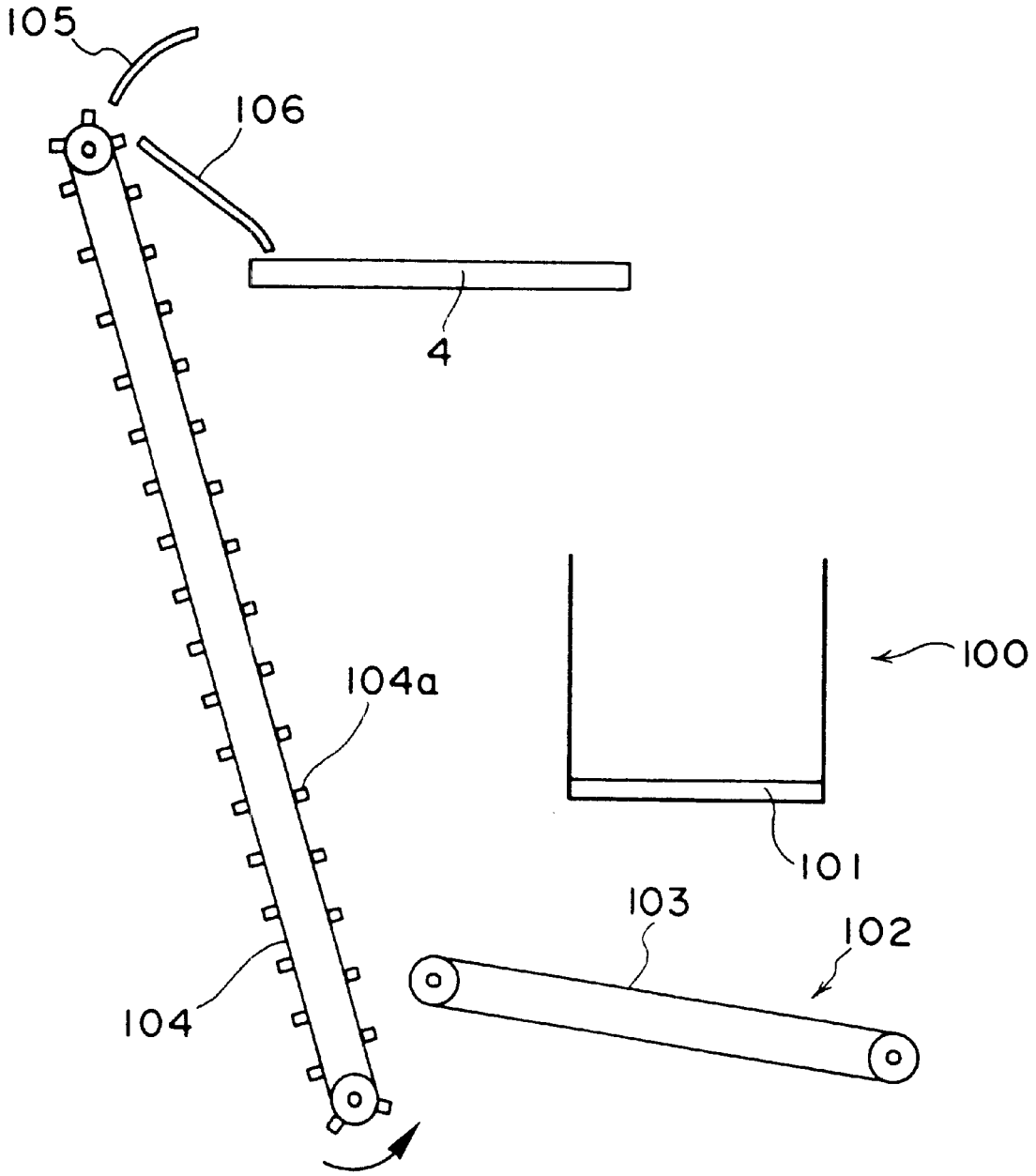
FIG. 10 is a schematic partial cross sectional view of a coin wrapping machine which is a further embodiment of the present invention.

FIG. 10 is a schematic partial cross sectional view of a coin wrapping machine which is a further preferred embodiment of the present invention.

As shown in FIG. 10, in this embodiment, a second coin sorting and collecting box 100 is provided with an opening and closing gate 101 at the bottom portion thereof so that coins collected in the second coin sorting and collecting box 100 can by opening the opening and closing gate 101 be fed into a lower hopper 102 provided below the second coin sorting and collecting box 100.

As shown in FIG. 10, the bottom portion of the lower hopper 102 is formed by a first endless belt 103 disposed in such a manner that the position thereof becomes gradually higher toward the left in FIG. 10.

As shown in FIG. 10, a second endless belt 104 is provided between the lower hopper 102 and the rotatable disk 4 connected to the coin passage 5 for receiving coins from the first endless belt 103 and the second endless belt 104 is formed with a plurality of comb tooth-like projections 104*a*.

The first endless belt 103 can be intermittently driven and when the first endless belt 103 is intermittently driven, coins accommodated in the lower hopper 102 and held on the first endless belt 103 are fed one by one onto the second endless belt 104 and the lower edges thereof are engaged with the comb tooth-like projections 104*a* of the second endless belt 104, whereby coins are transported from the lower hopper 102 toward the rotatable disk 4 while the surfaces of the coins are aligned with the surface of the second endless belt 104.

A scraper plate 105 is mounted to the main body 1 of the coin wrapping machine in the vicinity of the upper end portion of the second endless belt 104 so as that it can abut against the upper edges of coins transported by the second endless belt 104 while the lower edges thereof are engaged with the comb tooth-like projections 104*a* of the second endless belt 104 and coins transported from the lower hopper 102 to the rotatable disk 4 can be scraped by the scraper plate 105 from the second endless belt 104 and fed onto the rotatable disk 4 via a chute 106.

In the thus constituted coin wrapping machine according to this embodiment, when a counting mode is selected, coins are counted in accordance with the flow chart shown in FIG. 4 and unacceptable coins are collected in the first coin sorting and collecting box (not shown) via the first coin sorting and collecting opening 31 and the chute (not shown). On the other hand, all of coins of different denominations from that of coins to be wrapped and new issue coins of the denomination to be wrapped are collected in the second coin sorting and collecting box 100 via the second coin sorting and collecting opening 36 and the chute (not shown) and all past issue circulating old coins of the denomination to be wrapped are led to and collected in the coin take-out box (not shown) via the third coin sorting and collecting opening 46, the cylindrical coin guide member 48 and the chute 49.

After the counting operation of past issue circulating old coins of the same denomination as that of new issue coins has been completed in this manner, when the wrapping mode is selected and the wrapping of new issue coins is instructed by the operator, the control unit 90 outputs a drive signal to a motor (not shown) for driving the opening and closing gate 101, thereby opening the opening and closing gate 101 provided at the bottom portion of the second coin sorting and collecting box 100 and dropping coins of different denominations from that of coins to be wrapped and new issue coins of the denomination to be wrapped and accommodated in the second coin sorting and collecting box 100 onto the first endless belt 103 of the lower hopper 102 provided below the second coin sorting and collecting box 100.

The control unit 90 further outputs a drive signal to a motor (not show) for driving the first endless belt 103 of the lower hopper 102 and the second endless belt 104, thereby driving the first endless belt 103 and the second endless belt 104.

As a result, the first endless belt 103 is intermittently driven and coins held on the first endless belt 103 are fed one by one onto the second endless belt 104 so that the lower edges thereof are engaged with the comb tooth-like projections 104*a* of the second endless belt 104 and the coins are transported from the lower hopper 102 to the rotatable disk 4 while the surfaces of the coins are aligned with the surface of the second endless belt 104.

The coins are transported toward the rotatable disk 4, while the lower edges thereof are engaged with the comb tooth-like projections 104*a* of the second endless belt 104, and abut against the scraper plate 105 mounted to the main body of the coin wrapping machine in the vicinity of the upper end portion of the second endless belt 104, thereby being scraped off from the second endless belt 104 to be fed onto the rotatable disk 4 via the chute 106.

According to this embodiment, at the counting mode, coins of different denominations from that of coins to be counted and new issue coins of the denomination to be counted are collected in the second coin sorting and collecting box 100 separately from past issue circulating old coins. When the new issue coins are to be wrapped, the coins of different denominations from that of coins to be counted and the new issue coins of the denomination to be counted and collected in the second coin sorting and collecting box 100 are lifted by the first endless belt 103 and the second endless belt 104 to the level of the rotatable disk 4 and are scraped by the scraper plate 105 from the second endless belt 104 to be automatically fed onto the rotatable disk 4. Therefore, merely by the operator depositing coins into the coin depositing opening 2 prior to performing the operation under the counting mode, it is possible to collect past issue circulating coins of the denomination to be wrapped separately from new issue coins and to wrap the new issue coins, thereby producing a wrapped coin roll. Accordingly, it is possible to markedly improve the efficiency for sorting coins and wrapping coins.

The present invention has thus been shown and described with reference to specific embodiments. However, it should be noted that the present invention is in no way limited to the details of the described arrangements but changes and modifications may be made without departing from the scope of the appended claims.

For example, in the embodiment preformed in accordance with the flow chart shown in FIG. 4, when the counting operation of coins is performed, unacceptable coins are collected in the first coin sorting and collecting box by the first coin sorting member 32 via the first coin sorting and collecting opening 31 and the chute, and coins of different denominations from that of coins to be counted and new issue coins of the denomination to be counted are collected in the second coin sorting and collecting box by the second coin sorting member 37 via the second coin sorting and collecting opening 36 and the chute. On the other hand, past issue circulating coins of the denomination to be counted are collected by the third coin sorting and collecting member 47 in the coin take-out box via the third coin sorting and collecting opening 46, the cylindrical coin guide member 48 and the chute 49. However, coins of different denominations from that of coins to be counted and new issue coins of the denomination to be counted may be collected in the first coin sorting and collecting box and unacceptable coins may be collected in the second coin sorting and collecting box.

Further, in the embodiment preformed in accordance with the flow chart shown in FIG. 5, when the wrapping operation of coins is performed, unacceptable coins and past issue circulating old coins which by mistake were not collected in the first coin sorting and collecting box by the first coin sorting member 32 via the first coin sorting and collecting opening 31 and the chute, and acceptable coins of different denominations from that of coins to be wrapped are collected in the second coin sorting and collecting box by the second coin sorting member 37 via the second coin sorting and collecting opening 36 and the chute. However, acceptable coins of different denominations from that of coins to be wrapped may be collected in the first coin sorting and collecting box and unacceptable coins and past issue circulating old coins which by mistake were not collected may be collected in the second coin sorting and collecting box. Moreover, since all unacceptable coins and past issue circulating coins collected in the wrapping operation are ones which by mistake were not collected in the counting operation and the number thereof is very few, either unacceptable coins or past issue circulating coins may be collected in the first coin sorting and collecting box or the second coin sorting and collecting box together with acceptable coins of different denominations from that of coins to be wrapped.

Furthermore, in the embodiment preformed in accordance with the flow chart shown in FIG. 5, the counting mode is selected and the counting operation is performed, thereby. collecting new issue coins among coins to be wrapped in the second coin sorting and collecting box via the second coin sorting and collecting opening 36 and the chute, and counting and leading past issue circulating coins of the same denomination as that of the new issue coins to the coin take-out box via the third coin sorting and collecting opening 46, the cylindrical coin guide member 48 and the chute 49 to be collected therein. The coins collected in the second coin sorting and collecting box are then deposited onto the rotatable disk 4 and collected together with coins of different denominations from that of coins to be wrapped and unacceptable coins separately from the new issue coins without counting past issue circulating old coins which have by mistake not been collected in the counting operation and the new issue coins are wrapped. However, similarly to the embodiment preformed in accordance with the flow chart shown in FIG. 6, past issue circulating old coins may be counted and led to the coin take-out box to be collected therein so that they can be automatically counted.

Moreover, in the embodiment preformed in accordance with the flow chart shown in FIG. 6, when the wrapping operation under the second wrapping mode is performed, unacceptable coins are collected by the first coin sorting member 32 in the first coin sorting and collecting box via the first coin sorting and collecting opening 31 and the chute, and acceptable coins of different denominations from that of coins to be wrapped are collected by the second coin sorting member 37 in the second coin sorting and collecting box via the second coin sorting and collecting opening 36 and the chute. On the other hand, past issue circulating coins of the denomination to be wrapped are collected by the third coin sorting member 47 in the coin take-out box via the third coin sorting and collecting opening 46, the cylindrical coin guide member 48 and the chute 49. However, past issue circulating coins of the denomination to be wrapped may be collected in the second coin sorting and collecting box and acceptable coins of different denominations from that of coins to be wrapped may be collected in the coin take-out box. Further, past issue circulating coins of the denomination to be wrapped may be collected in the first coin sorting and collecting box and unacceptable coins may be collected in the second coin sorting and collecting box. Furthermore, it is possible to collect past issue circulating coins of the denomination to be wrapped in the first coin sorting and collecting box, collect acceptable coins of different denominations from that of coins to be wrapped in the second coin sorting and collecting box and collect unacceptable coins in the coin take-out box. Moreover, it is possible to collect acceptable coins of different denominations from that of coins to be wrapped in the first coin sorting and collecting box, collect past issue circulating coins of the denomination to be wrapped in the second coin sorting and collecting box and collect unacceptable coins in the coin take-out box. Further, it is possible to collect acceptable coins of different denominations from that of coins to be wrapped in the first coin sorting and collecting box, collect unacceptable coins in the second coin sorting and collecting box and collect past issue circulating coins of the denomination to be wrapped in the coin take-out box. In short, insofar as unacceptable coins, acceptable coins of different denominations from that of coins to be wrapped and past issue circulating coins of the denomination to be wrapped can be collected separately from each other in the first coin sorting and collecting box, the second coin sorting and collecting box or the coin take-out box, there is no particular restriction on which among the first coin sorting and collecting box, the second coin sorting and collecting box and the coin take-out box collects unacceptable coins, acceptable coins of different denominations from that of coins to be wrapped or past issue circulating coins of the denomination to be wrapped.

Further, in the embodiment preformed in accordance with the flow chart shown in FIG. 6, when the wrapping operation under the second wrapping mode is performed, unacceptable coins are collected by the first coin sorting member 32 in the first coin sorting and collecting box via the first coin sorting and collecting opening 31 and the chute, and acceptable coins of different denominations from that of coins to be wrapped are collected by the second coin sorting member 37 in the second coin sorting and collecting box via the second coin sorting and collecting opening 36 and the chute. On the other hand, past issue circulating coins of the denomination to be wrapped are collected by the third coin sorting member 47 in the coin take-out box via the third coin sorting and collecting opening 46, the cylindrical coin guide member 48 and the chute 49 and only new issue coins of the denomination to be wrapped are fed to the coin wrapping apparatus 60. However, past issue circulating coins of the denomination to be wrapped may be collected in the second coin sorting and collecting box and acceptable coins of different denominations from that of coins to be wrapped may be collected in the coin take-out box. Further, past issue circulating coins of the denomination to be wrapped may be collected in the first coin sorting and collecting box and unacceptable coins may be collected in the second coin sorting and collecting box. Furthermore, it is possible to collect past issue circulating coins of the denomination to be wrapped in the first coin sorting and collecting box, collect acceptable coins of different denominations from that of coins to be wrapped in the second coin sorting and collecting box and collect unacceptable coins in the coin take-out box. Moreover, it is possible to collect acceptable coins of different denominations from that of coins to be wrapped in the first coin sorting and collecting box, collect past issue circulating coins of the denomination to be wrapped in the second coin sorting and collecting box and collect unacceptable coins in the coin take-out box. Further, acceptable coins of different denominations from that of coins to be wrapped in the first coin sorting and collecting box, collect unacceptable coins in the second coin sorting and collecting box and collect past issue circulating coins of the denomination to be wrapped in the coin take-out box. In short, insofar as unacceptable coins, acceptable coins of different denominations from that of coins to be wrapped and past issue circulating coins of the denomination to be wrapped can be collected separately from each other in the first coin sorting and collecting box, the second coin sorting and collecting box or the coin take-out box, there is no particular restriction on which among the first coin sorting and collecting box, the second coin sorting and collecting box and the coin take-out box collects unacceptable coins, acceptable coins of different denominations from that of coins to be wrapped or past issue circulating coins of the denomination to be wrapped.

Furthermore, in the embodiment performed in accordance with the flow chart shown in FIG. 7, although past issue circulating coins of the denomination to be wrapped are counted and collected in the coin take-out box, the past issue circulating coins of the denomination to be wrapped may be collected in the coin take-out box without being counted.

Moreover, in the embodiment performed in accordance with the flow chart shown in FIG. 8, when the counting operation is performed, unacceptable coins and coins of different denominations from that of coins to be counted are collected in the first coin sorting and collecting box via the first coin sorting and collecting opening 31 and the chute, and new issue coins of the denomination to be counted are collected in the second coin sorting and collecting box via the second coin sorting and collecting opening 36 and the chute. On the other hand, past issue circulating coins of the same denomination as that of the new issue coins are led to and collected in the coin take-out box via the third coin sorting and collecting opening 46, the cylindrical coin guide member 48 and the chute 49. However, unacceptable coins and coins of different denominations from that of coins to be counted may be collected in the second coin sorting and collecting box via the second coin sorting and collecting opening 36 and the chute and the new issue coins of the denomination to be counted may be collected in the first coin sorting and collecting box via the first coin sorting and collecting opening 31 and the chute.

Further, in the embodiment performed in accordance with the flow chart shown in FIG. 9, when the counting operation is performed, unacceptable coins and coins of different denominations from that of coins to be counted are collected in the first coin sorting and collecting box via the first coin sorting and collecting opening 31 and the chute, and past issue circulating coins of the denomination to be counted and the same denomination as that of new issue coins are collected in the second coin sorting and collecting box via the second coin sorting and collecting opening 36 and the chute. On the other hand, the new issue coins of the denomination to be counted are led to and collected in the coin take-out box via the third coin sorting and collecting opening 46, the cylindrical coin guide member 48 and the chute 49. However, unacceptable coins and coins of different denominations from that of coins to be counted may be collected in the second coin sorting and collecting box via the second coin sorting and collecting opening 36 and the chute and the past issue circulating coins of the denomination to be counted and the same denomination as that of new issue coins may be collected in the first coin sorting and collecting box via the first coin sorting and collecting opening 31 and the chute.

Furthermore, in the above described embodiments, although the magnetic sensor 40 is provided in the vicinity of the downstream end portion of the second straight passage 11, an optical sensor may be employed instead of the magnetic sensor.

Moreover, in the embodiment shown in FIG. 10, the opening and closing gate 101 is provided at the bottom portion of the second coin sorting and collecting box 100 and coins collected in the second coin sorting and collecting box 100 are fed into the lower hopper 102 provided below the second coin sorting and collecting box 100 by opening the opening and closing gate 101. Further, coins fed into the lower hopper 102 are fed onto the rotatable disk 4 provided above the lower hopper 102 by the first endless belt 103 provided below the lower hopper 102 and the second endless belt 104 adjacent to one end portion of the first endless belt 103. However, it is possible to provide an opening and closing gate at the bottom portion of the first coin sorting and collecting box, feed coins collected in the first coin sorting and collecting box into the lower hopper 102 provided below the first coin sorting and collecting box by opening the opening and closing gate, and feed coins fed into the lower hopper 102 onto the rotatable disk 4 provided above the lower hopper 102 by the first endless belt 103 provided below the lower hopper 102 and the second endless belt 104 adjacent to one end portion of the first endless belt 103. It is furthermore possible to provide an opening and closing gate at the bottom portion of the coin take-out box, feed coins collected in the coin take-out box into the lower hopper 102 provided below the coin take-out box by opening the opening and closing gate, and feed coins fed into the lower hopper 102 onto the rotatable disk 4 provided above the lower hopper 102 by the first endless belt 103 provided below the lower hopper 102 and the second endless belt 104 adjacent to one end portion of the first endless belt 103.

Further, in the embodiment shown in FIG. 10, although coins are automatically fed by the first endless belt 103 and the second endless belt 104 from the lower hopper 102 onto the rotatable disk 4, it is sufficient to provide a mechanism capable of automatically feeding coins of different denominations from that of coins to be wrapped and new issue coins of the denomination to be wrapped and collected in the second coin sorting and collecting box 100 onto the rotatable disk 4 and the mechanism therefor is not limited to the arrangement shown in FIG. 10 but a mechanism such as that disclosed in Japanese Patent Application Laid Open No. 2000-20792 may be employed therefor.

Furthermore, in the above described embodiments, although the coin passage 5 includes the first straight passage 10 extending substantially parallel to the rear surface portion 1A of the main body 1 of the coin wrapping machine, the second straight passage 11 extending substantially parallel to the side surface portion 1B of the main body 1 of the coin wrapping machine and substantially perpendicularly to the first straight passage 10, the third straight passage 12 extending substantially parallel to the front surface portion 1C of the main body 1 of the coin wrapping machine and substantially perpendicularly to the second straight passage 11, the first curved passage 13 connected to the downstream end portion of the first straight passage 10 and the upstream end portion of the second straight passage 11 for turning the coin transporting direction by substantially 90 degrees and the second curved passage 14 connected to the downstream end portion of the second straight passage 11 and the upstream end portion of the third straight passage 12 for turning the coin transporting direction by substantially 90 degrees, thereby being disposed so as to surround the rotatable disk 4, it is not absolutely necessary to dispose the coin passage 5 in this manner.

Moreover, in the above described embodiments, although the display system of the coin wrapping machine includes the display panel 87 and the alarm means 88 and when an error occurs, the display panel 87 is caused to display an error message and the alarm means 88 is caused to produce an alarm, it is not absolutely necessary to provide the alarm means 88.

According to the present invention, it is possible to provide a coin wrapping machine which can reliably sort new issue coins and past issue circulating old coins of the same denomination from each other and efficiently collect old coins without any special mechanism.

According to the present invention, it is further possible to provide a coin wrapping machine which can reliably sort new issue coins and past issue circulating old coins of the same denomination from each other, efficiently collect old coins without any special mechanism while counting the new issue coins and the old coins and, at the same time, wrap the new issue coins to produce a wrapped coin roll.

What is claimed is:

1. A coin wrapping machine comprising an operation mode selecting means for selecting a counting mode for counting coins or a wrapping mode for wrapping coins, a denomination specifying means for specifying a denomination of coins to be handled, a rotatable disk for feeding coins one by one to a coin passage, a first coin sensor provided in the coin passage for detecting physical properties of coins, a second coin sensor provided in the coin passage downstream of the first coin sensor for detecting physical properties of coins different from those to be detected by the first coin sensor, a first coin sorting and collecting means provided in the coin passage downstream of the second coin sensor for sorting coins and collecting sorted coins, a second coin sorting and collecting means provided in the coin passage downstream of the second coin sensor for sorting coins and collecting sorted coins, a third coin sorting and collecting means provided in the coin passage downstream of the second coin sensor for sorting coins and collecting sorted coins, a discriminating means for discriminating, based on the physical properties detected by the first coin sensor and the second coin sensor, whether or not a coin is acceptable, the denomination of the coin when it is acceptable and whether or not the denomination of the coin coincides with that specified by the denomination specifying means, and a coin stacking and wrapping apparatus connected to a downstream end portion of the coin passage for stacking and wrapping coins, the discriminating means being made responsive to inclusion of new issue coins and past issue circulating coins among coins of the denomination for further discriminating whether the coin is a new issue coin or a past issue circulating coin, the first coin sorting and collecting means being made responsive to such inclusion for sorting and collecting coins discriminated unacceptable by the discriminating means when the counting mode is selected by the operation mode selecting means, and the second coin sorting and collecting means being made responsive to such inclusion for sorting and collecting one kind between the new issue coins and the past issue circulating coins.

2. A coin wrapping machine in accordance with claim 1, wherein the third coin sorting and collecting means is made responsive to inclusion of new issue coins and past issue circulating coins among coins of the denomination specified by the denomination specifying means for sorting and collecting the other kind between the new issue coins and the past issue circulating coins.

3. A coin wrapping machine in accordance with claim 2, wherein the second coin sorting and collecting means is made responsive to inclusion of new issue coins and past issue circulating coins among coins of the denomination specified by the denomination specifying means for sorting and collecting coins of denominations different from that specified by the denomination specifying means in addition to one kind between the new issue coins and the past issue circulating coins.

4. A coin wrapping machine in accordance with claim 3, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

5. A coin wrapping machine in accordance with claim 3, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

6. A coin wrapping machine in accordance with claim 2, wherein the third coin sorting and collecting means is made responsive to inclusion of new issue coins and past issue circulating coins among coins of the denomination specified by the denomination specifying means for sorting and collecting coins of denominations different from that specified by the denomination specifying means in addition to the other kind between the new issue coins and the past issue circulating coins.

7. A coin wrapping machine in accordance with claim 6, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

8. A coin wrapping machine in accordance with claim 6, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

9. A coin wrapping machine in accordance with claim 2, wherein the first coin sorting and collecting means is made responsive to inclusion of new issue coins and past issue circulating coins among coins of the denomination specified by the denomination specifying means for sorting and collecting coins of denominations different from that specified by the denomination specifying means in addition to coins discriminated unacceptable by the discriminating means.

10. A coin wrapping machine in accordance with claim 9, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

11. A coin wrapping machine in accordance with claim 9, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

12. A coin wrapping machine in accordance with claim 2, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

13. A coin wrapping machine in accordance with claim 2, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

14. A coin wrapping machine in accordance with claim 1, wherein the second coin sorting and collecting means is made responsive to inclusion of new issue coins and past issue circulating coins among coins of the denomination specified by the denomination specifying means for sorting and collecting coins of denominations different from that specified by the denomination specifying means in addition to one kind between the new issue coins and the past issue circulating coins.

15. A coin wrapping machine in accordance with claim 14, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

16. A coin wrapping machine in accordance with claim 3, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

17. A coin wrapping machine in accordance with claim 1, wherein the third coin sorting and collecting means is made responsive to inclusion of new issue coins and past issue circulating coins among coins of the denomination specified by the denomination specifying means for sorting and collecting coins of denominations different from that specified by the denomination specifying means in addition to the other kind between the new issue coins and the past issue circulating coins.

18. A coin wrapping machine in accordance with claim 17, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

19. A coin wrapping machine in accordance with claim 17, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

20. A coin wrapping machine in accordance with claim 1, wherein the first coin sorting and collecting means is made responsive to inclusion of new issue coins and past issue circulating coins among coins of the denomination specified by the denomination specifying means for sorting and collecting coins of denominations different from that specified by the denomination specifying means in addition to coins discriminated unacceptable by the discriminating means.

21. A coin wrapping machine in accordance with claim 20, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

22. A coin wrapping machine in accordance with claim 20, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

23. A coin wrapping machine in accordance with claim 1, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting coins of denominations different from that specified by the denomination specifying means, and the third coin sorting and collecting means is made responsive to such inclusion and specification for sorting and collecting the past issue circulating coins.

24. A coin wrapping machine in accordance with claim 1, wherein in the case where the wrapping mode is selected by the operation mode selecting means, the first coin sorting and collecting means is made responsive to inclusion of new issue coins and past issue circulating coins among coins of the denomination specified by the denomination specifying means and specification of the denomination of the new issue coins as the denomination of coins to be wrapped for sorting and collecting unacceptable coins, the second coin sorting and collecting means is made responsive to such inclusion and specification for sorting and collecting past issue circulating coins, and the third coin sorting and collecting means is made responsive to such inclusion and specification for sorting and collecting coins of denominations different from that specified by the denomination specifying means.

25. A coin wrapping machine in accordance with claim 1, wherein the first coin sorting and collecting means in provided with a first coin sorting member movable between a projection position where it projects into the coin passage and a retracted position where it is retracted from the coin passage and a first coin sorting and collecting opening having a width smaller than a diameter of the smallest coins to be handled, the second coin sorting and collecting means is provided with a second coin sorting member movable between a projection position where it projects into the coin passage and a retracted position where it is retracted from the coin passage and a second coin sorting and collecting opening having a width smaller than a diameter of the smallest coins to be handled, and the third coin sorting and collecting means is provided with a third coin sorting member movable between a projection position where it projects into the coin passage and a retracted position where it is retracted from the coin passage and a third coin sorting and collecting opening having a width smaller than a diameter of the smallest coins to be handled.

26. A coin wrapping machine in accordance with claim 25, wherein the first coin sorting and collecting means is constituted to locate the first coin sorting member at the projection position thereof and to drop coins into the first coin sorting and collecting opening to sort them, the second coin sorting and collecting means is constituted to locate the second coin sorting member at the projection position thereof and to drop coins into the second coin sorting and collecting opening to sort them, and the third coin sorting and collecting means is constituted to locate the third coin sorting member at the projection position thereof and to drop coins into the third coin sorting and collecting opening to sort them.

27. A coin wrapping machine in accordance with claim 1, wherein at least one of the first coin sorting and collecting means, the second coin sorting and collecting means, and the third coin sorting and collecting means includes a coin accommodating section where sorted and collected coin are to be accommodated and which further includes a coin feeding means for feeding coins accommodated in the coin accommodating section onto the rotatable disk.

28. A coin wrapping machine in accordance with claim 27, wherein the coin feeding means is provided with an endless belt formed with a plurality of engaging portions for engaging coins and disposed between the coin accommodating section and the rotatable disk.

29. A coin wrapping machine in accordance with claim 28, wherein the coin feeding means further includes a disengaging means for disengaging the engagement between the coins and the plurality of engaging portions.

30. A coin wrapping machine in accordance with claim 1, wherein the first coin sorting and collecting means is provided in the coin passage upstream of the second coin sorting and collecting means, and the third coin sorting and collecting means is provided in the coin passage downstream of the second coin sorting and collecting means.

* * * * *